US008790532B2

(12) United States Patent
Rakowski

(10) Patent No.: US 8,790,532 B2
(45) Date of Patent: Jul. 29, 2014

(54) CHEMICAL REMOVAL OF SURFACE DEFECTS FROM GRAIN ORIENTED ELECTRICAL STEEL

(75) Inventor: James M. Rakowski, Allison Park, PA (US)

(73) Assignee: ATI Properties, Inc., Albany, NY (US)

( * ) Notice: Subject to any disclaimer, the term of this patent is extended or adjusted under 35 U.S.C. 154(b) by 101 days.

(21) Appl. No.: 13/352,743

(22) Filed: Jan. 18, 2012

(65) Prior Publication Data

US 2013/0180946 A1 Jul. 18, 2013

(51) Int. Cl.
*C03C 15/00* (2006.01)
*C03C 25/68* (2006.01)

(52) U.S. Cl.
USPC ..... 216/83; 216/100; 216/108

(58) Field of Classification Search
None
See application file for complete search history.

(56) References Cited

U.S. PATENT DOCUMENTS

| | | | | |
|---|---|---|---|---|
| 3,932,236 | A | 1/1976 | Wada et al. | |
| 4,123,337 | A | 10/1978 | Brewer et al. | |
| 4,846,939 | A * | 7/1989 | Yoshida et al. | 205/118 |
| 4,863,531 | A * | 9/1989 | Wada et al. | 148/111 |
| 6,451,128 | B1 * | 9/2002 | Lee et al. | 148/111 |

FOREIGN PATENT DOCUMENTS

JP 2-30778 A 2/1990

OTHER PUBLICATIONS

JIS C 2553 : 2000, "Grain-oriented Magnetic Steel sheet and Strip", Japanese Industrial Standard, Translated and Published by Japanese Standards Association, Revised Feb. 20, 2000, 22 pages.
A 677-07, Standard Specification for Nonoriented Electrical Steel Fully Processed Types, ASTM International, published Dec. 2007, originally approved in 1973, 6 pages.
DS/EN 10107, Dansk Standard, "Grain-oriented electrical steel sheet and strip delivered in the fully processed state", Aug. 18, 2005, 18 pages.
A 967-05$^{\beta 2}$, Standard Specification for Chemical Passivation Treatments for Stainless Steel Parts, ASTM International, published Sep. 2005, originally approved in 1996, 7 pages.
A 876-09, Standard Specification for Flat-Rolled, Grain-Oriented, Silicon-Iron, Electrical Steel, Fully Processed Types, ASTM International, published Jun. 2009, originally approved in 1987, 6 pages.
A370-11a, Standard Test Methods and Definitions for Mechanical Testing of Steel Products, ASTM International, published Dec. 2011, originally approved in 1953, 47 pages.
ANSI/ASTM A 344-68 (Reapproved 1972), Standard Test Methods for Electrical and Mechanical Properties of Magnetic Materials, ASTM International, effective Aug. 15, 1968, originally issued 1949, 12 pages.

* cited by examiner

*Primary Examiner* — Duy Deo
(74) *Attorney, Agent, or Firm* — K & L Gates LLP; John E. Grosselin, III

(57) ABSTRACT

A method of reducing defect heights of iron mound defects on a mill glass coated electrical steel, comprises contacting at least a portion of a surface of a mill glass coated electrical steel with an acidic solution for a contacting time sufficient to reduce an average height of iron defects on the surface to a an average height in a range of 0 percent to 150 percent of the thickness of the mill glass coating, without effectively removing the mill glass coating. After contacting, the acid contacted mill glass coated electrical steel is rinsed with water and dried.

22 Claims, 31 Drawing Sheets

Mg Ka1_2

Si Ka1

O Ka1

Mn Ka1

Fe Ka1

S Ka1

Fe Ka1

Si Ka1

Mg Ka1_2

S Ka1

O Ka1

CHEMICAL REMOVAL OF SURFACE DEFECTS FROM GRAIN ORIENTED ELECTRICAL STEEL

BACKGROUND OF THE TECHNOLOGY

1. Field of the Technology

The present disclosure relates to a chemical method for removing defects from the surface of glass coated electrical steel.

2. Description of the Background of the Technology

Electrical steel is an iron alloy which may have from zero to 6.5 percent by weight of silicon. Commercial alloys usually have silicon content up to 3.2 percent by weight, as higher concentrations of silicon may exhibit brittleness during cold rolling. Manganese and aluminum can be added up to 0.5%. Increasing the amount of silicon inhibits eddy currents and narrows the hysteresis loop of the material, thus lowering the core losses. However, the grain structure hardens and embrittles the metal, which adversely affects the workability of the material, especially when rolling it. When alloying, the concentration levels of carbon, sulfur, oxygen and nitrogen must be kept low, as these elements result in the formation of carbide, sulfide, oxide and nitride particles. These particles, even in particles as small as one micrometer in diameter, increase hysteresis losses while also decreasing magnetic permeability. The presence of carbon has a more detrimental effect than sulfur or oxygen. Carbon also causes magnetic aging when it slowly leaves the solid solution and precipitates as carbides, thus resulting in an increase in power loss over time. For these reasons, the carbon level is kept to 0.005 percent by weight or lower. The carbon level can be reduced by annealing the steel in a decarburizing atmosphere, such as hydrogen.

Electrical steel is available as grain oriented electrical steel (GOES) and non-oriented electrical steel. GOES is used for transformer cores and in certain other electrical applications. GOES sheet is processed so that the crystal grain orientation of the sheet is tightly controlled and the sheet properties are optimized in the rolling direction. As a result of the grain orientation, the magnetic flux density in GOES sheet may be increased by about 30 percent in the coil rolling direction, although the magnetic saturation may be decreased by about 5 percent. GOES sheet is usually manufactured in the form of cold-rolled strips less than 0.35 mm thick. The strips are stacked together as "laminations" to form a core. The assembled cores may be used as laminated cores in electrical transformers.

In the conventional process of manufacturing transformer cores from GOES sheet, a glass film of silicon-rich oxide is provided on surfaces of the sheet. After final cold rolling, the GOES sheet undergoes a final normalizing in an atmosphere of hydrogen and nitrogen. This forms a thin oxide layer on the surface that contains silicon and iron. The GOES sheet surface is then coated with magnesium oxide (MgO) powder. During the final annealing in a hydrogen atmosphere, silicon in the thin oxide formed in the normalizing step reacts with the MgO and forms a thin, uniform, silicon-rich insulating layer of crystalline forsterite ($Mg_2SiO_4$) on the sheet surface. The forsterite coated GOES sheet is scrubbed cleaned. GOES sheet with a forsterite layer is generally known in the art as "mill glass" or, more simply, "scrub material".

For use in transformer cores, the scrub material is top coated with an additional electrically insulating layer. Monomagnesium phosphate ($Mg(H_2PO_4)_2$), with or without inorganic filler materials, is one example of an electrically insulating coating that is applied over a mill glass coating. The top coat is added to increase the electrical resistivity of the surface and improve the electrical properties of the sheet.

Defects in the electrically insulating coatings on GOES sheet can allow current to leak through the coatings. These electrical shorts are problematic if, for example, the sheet is intended for transformer applications. Defects in the electrically insulating coatings can act as short circuit paths for current to flow between sheet laminations in an electrical transformer core, reducing electrical efficiency and increasing the generation of waste heat.

One type of mill glass coated GOES sheet defect is an "iron mound" defect. Iron mounds form during the steps of producing mill glass on electrical steel sheet. It is believed that iron mounds originate from iron-rich oxides produced during annealing of GOES. The iron-rich oxides are reduced in the dry hydrogen environment of the tunnel furnace high temperature soaking cycle. The resulting electrically conductive defect is rich in metallic iron and may protrude through the mill glass coating. A scrub material surface including iron mounds appears gray in color, with numerous small bright spots. FIGS. 1A-1C show the general morphology of iron mound defects on scrub material when viewed through a light optical microscope. The defects are raised from the surface and appear to comprise metallic iron and entrained iron oxides. As best shown in FIG. 1A, a gouge or tail in the base glass is often associated with an iron mound, running transverse to the rolling direction. The gouge is secondary to the iron mound and likely formed while the steel was tightly coiled, arising through friction between laminations during coil handling, and not during line processing which typically produces damage along the rolling direction. Iron mounds typically are 50-200 microns in diameter, are generally round or elliptical, and may protrude from the sheet surface by approximately 50 microns. 50 microns is considerably thicker than the entire electrically insulating glass coating provided on a finished GOES sheet, as the mill glass and the top coating are both only a few microns thick.

FIG. 2A is a secondary electron scanning electron micrograph of an iron mound on a GOES sheet, and FIG. 2B is a back scattered electron micrograph of the same iron mound. Heavier, i.e., high atomic number, elements backscatter electrons more strongly than light, i.e., low atomic number, elements and thus appear brighter in the image of FIG. 2B. Therefore, it can be inferred that in FIG. 2B the brighter portion of the image represents an iron mound, and the darker portion of the image represents the mill glass coating. FIG. 2C is a cross-section through an iron mound defect. The layer in the upper portion of FIG. 2C is a coating used to prepare the cross-section and does not represent the mill glass. The mill glass coating is not evident in FIG. 2C, as it is too thin to distinguish.

SEM microanalyses of an iron mound are shown in the scanning electron micrograph of FIG. 3A and the energy dispersive SEM X-ray maps of FIGS. 3B-3G. The X-ray maps of FIGS. 3B-3G are maps for the elements Mg, Si, O, Mn, Fe, and S, respectively. For each elemental map, the brightness of the image is determined by the presence and concentration of the element scanned for in the image. Examination of FIGS. 3B-3G indicates that the iron mound defect is composed mostly of iron (FIG. 3F). The presence of a substantial amount of oxygen is not detected in the iron mound (FIG. 3D), suggesting that the iron mound defects are comprised of electrically conductive iron metal. Regions outside of the iron mound defect are high in magnesium and silicon (FIGS. 3B and 3C), indicating the presence of the forsterite mill glass coating. Sulfur-rich particles are visible in the mill glass around the iron mound, and there also are indications in the images of sulfur in particles embedded in the mounds. The large sulfur concentration observed indicates that sulfur in the iron mound is probably a remnant from additives present in the MgO coating from which the forsterite mill glass forms.

Iron mound defects are very difficult to cover with one application of a phosphate top coating. The locally high electrical conductivity of the coated surface resulting from iron mounds generally dictates rework in the form of a second application of phosphate coating. Applying two layers of the top coat increases costs and production lead time and decreases the stacking factor of a GOES sheet product used in a transformer core, for example. As such, it would be advantageous to avoid the need to apply an additional top coat.

"Free iron" particles can form on stainless steel surfaces that have contacted ferrous tooling during processing. Ferrous tooling can embed the free iron particles into the stainless steel surface. The free iron particles can rust, which can lead to corrosion of the underlying stainless steel. Once corrosion of the underlying stainless steel begins, the corrosion can continue without the presence of the free iron. Free iron can be removed from stainless steel surfaces using a conventional passivation technique. ASTM 967-05 defines passivation as the chemical treatment of a stainless steel with a mild oxidant, such as nitric acid solution, for the purpose of removing free iron or other foreign matter from the surface, but which is generally not effective in removal of heat tint or oxide scale from the surface. The oxidizing nature of the acid encourages the formation of a native chromium oxide film, or passivation layer, which is responsible for the corrosion resistance of stainless steel. Although passivation is effective in removing iron deposits from a stainless steel surface, the technique is ineffective at removing iron from GOES and non-oriented electrical steel due to the absence of chromium in the steel.

U.S. Pat. No. 4,123,337 ("the '337 patent") discloses an electrolytic process that may be applied to GOES sheet for removing "small metallic nodules, particles and the like extending through or protruding above the insulative coating". The '337 patent discloses applying a voltage to a GOES coil disposed in an aqueous sodium nitrate or sodium chloride bath to pit away iron mound defects. Electrolytic processes, however, require additional infrastructure and may significantly increase production costs.

Accordingly, it would be advantageous to provide a novel method for removing or reducing the height of iron mound defects on mill glass coated electrical steel. Alternatively, the method would damage the iron mound defect to the point where it is rough enough to better retain a significant amount of monomagnesium phosphate applied top coating.

SUMMARY

According to a non-limiting aspect of the present disclosure, a method for reducing the height of iron mound defects on a mill glass coated electrical steel comprises contacting at least a portion of a surface of the mill glass coated electrical steel with an acidic solution for a time sufficient to reduce an average height of iron mound defects on the portion of the surface; and rinsing at least the treated portion or portions of the surface with water. In certain embodiments of the method, the average height of iron mound defects after treatment by the method is reduced to a height that is 0 to 150 percent of the thickness of the mill glass coating, wherein the contacting does not substantially remove the mill glass coating. In an embodiment, the contacting does not result in an average Franklin Insulation Test value of greater than 0.6 amperes. In another non-limiting embodiment, the contacting does not result in an average Franklin Insulation Test value of greater than 0.8 amperes. The electrical steel may be either GOES or non-oriented electrical steel.

According to another non-limiting aspect of the present disclosure, a method for reducing the height of iron mound defects on a mill glass coated electrical steel comprises providing a mill glass coated electrical steel; contacting at least a portion of a surface of the coated steel with an acidic solution for a time sufficient to reduce an average height of iron mound defects on the portion; and rinsing at least the treated portion of the surface with water. In certain embodiments of the method, the average height of iron mound defects after treatment by the method is reduced to a height that is 0 to 150 percent of the thickness of the mill glass coating, wherein the contacting does not effectively remove the mill glass coating. The electrical steel may be either GOES or non-oriented electrical steel.

According to yet another non-limiting aspect of the present disclosure, a method for reducing the height of iron mound defects on a mill glass coated electrical steel comprises contacting at least a portion of a surface of the mill glass coated electrical steel with an aqueous solution including 4 to 20 percent by weight carboxylic acid for a time in a range of 4 minutes to 20 minutes; rinsing the acid treated portion of the mill glass coated electrical steel surface with water; and drying the rinsed acid treated portion of the mill glass coated electrical steel surface, wherein the contacting does not effectively remove the mill glass coating. In a non-limiting embodiment, the carboxylic acid comprises citric acid. The electrical steel may be either GOES or a non-oriented electrical steel.

BRIEF DESCRIPTION OF THE DRAWINGS

The features and advantages of methods described herein may be better understood by reference to the accompanying drawings in which.

Figure 1A:
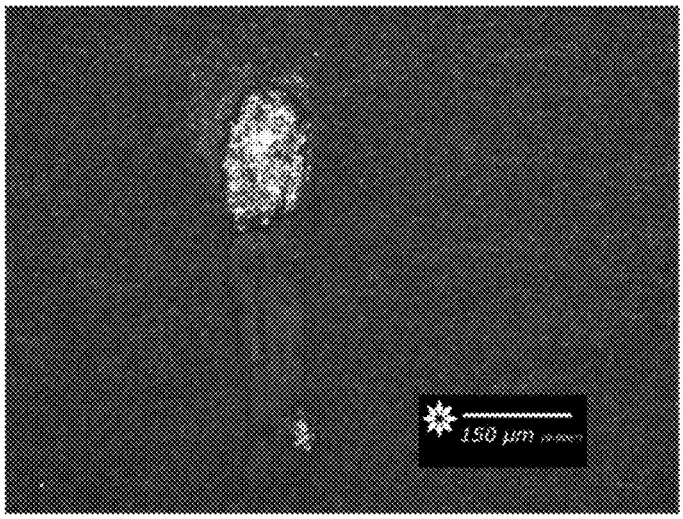
FIGS. 1A-1C are light micrographs of iron mound defects on mill glass coated electrical steel.
Figure 1B:
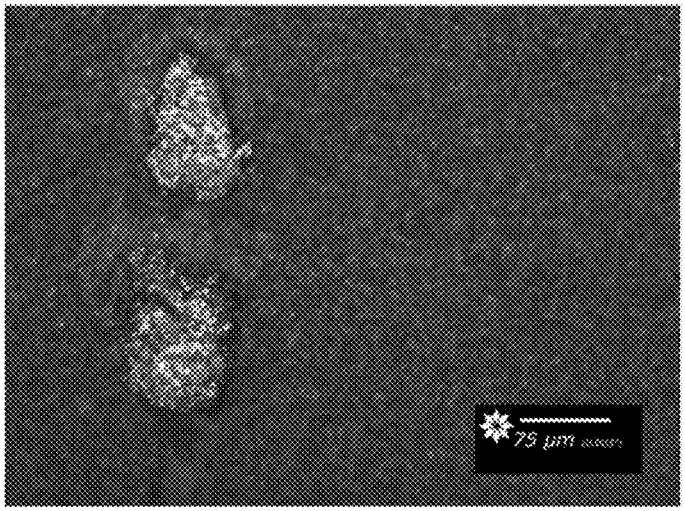
Figure 1C:
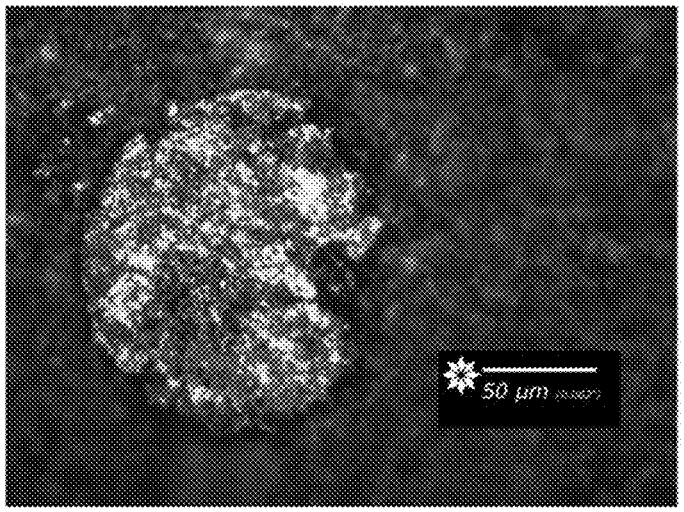
Figure 2A:
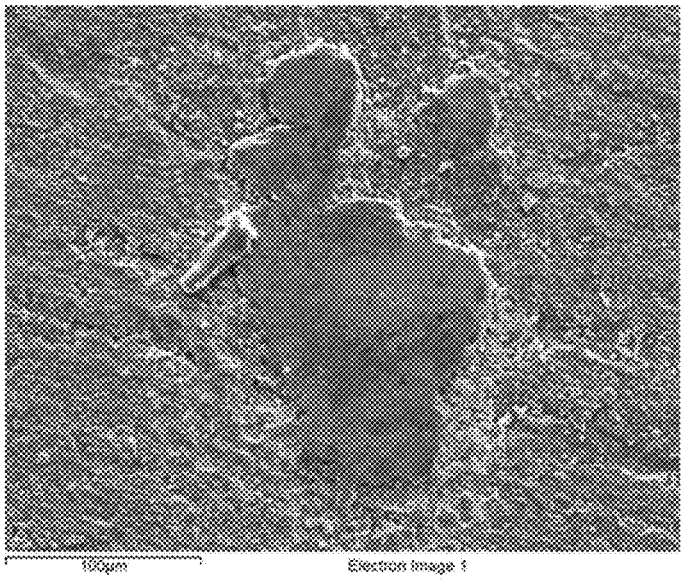
FIG. 2A is a secondary electron scanning electron micrograph of an iron mound defect on mill glass coated electrical steel.
Figure 2B:
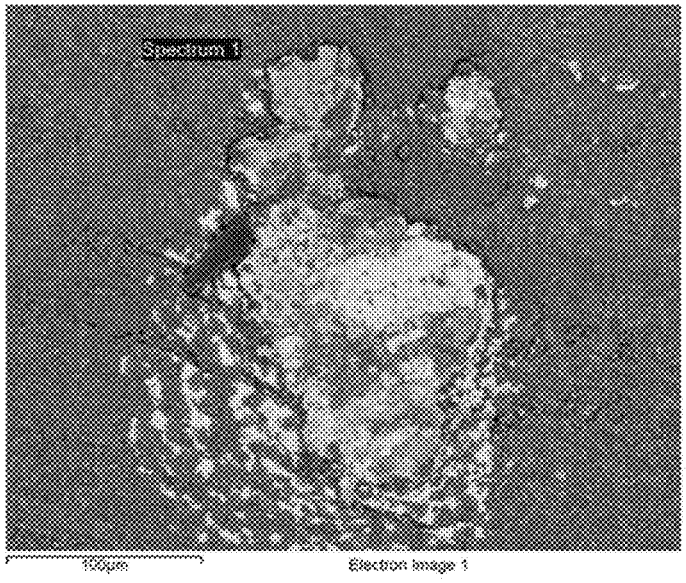
FIG. 2B is a back-scatted electron scanning electron micrograph of an iron mound defect on mill glass coated electrical steel.
Figure 2C:
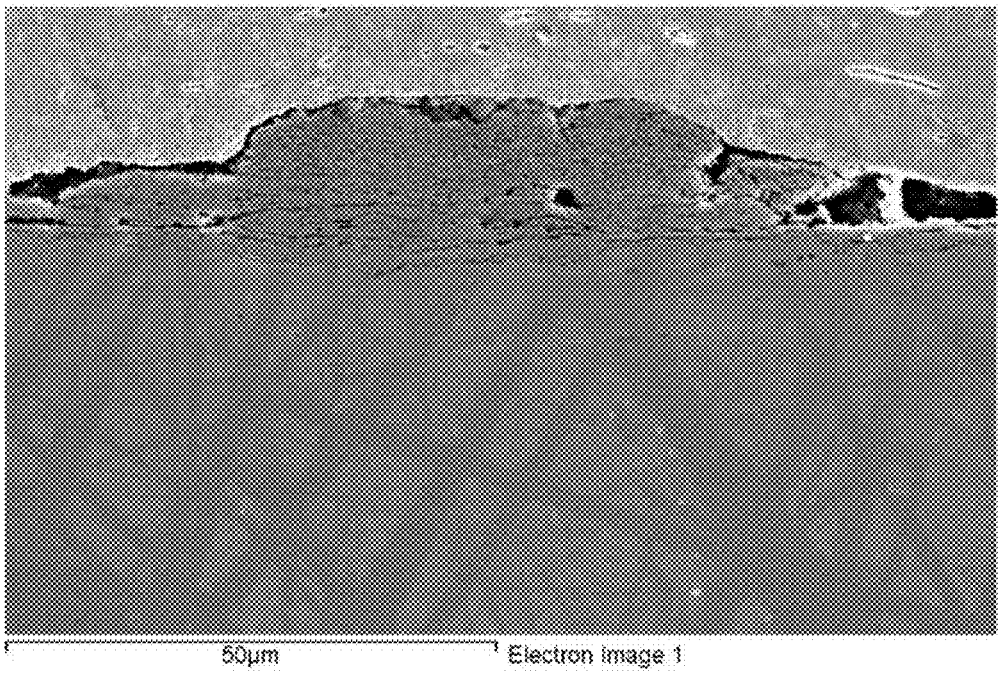
FIG. 2C is a scanning electron micrograph of a cross-section of a mounted and metallurgically polished iron mound defect on mill glass coated electrical steel.
Figure 3A:
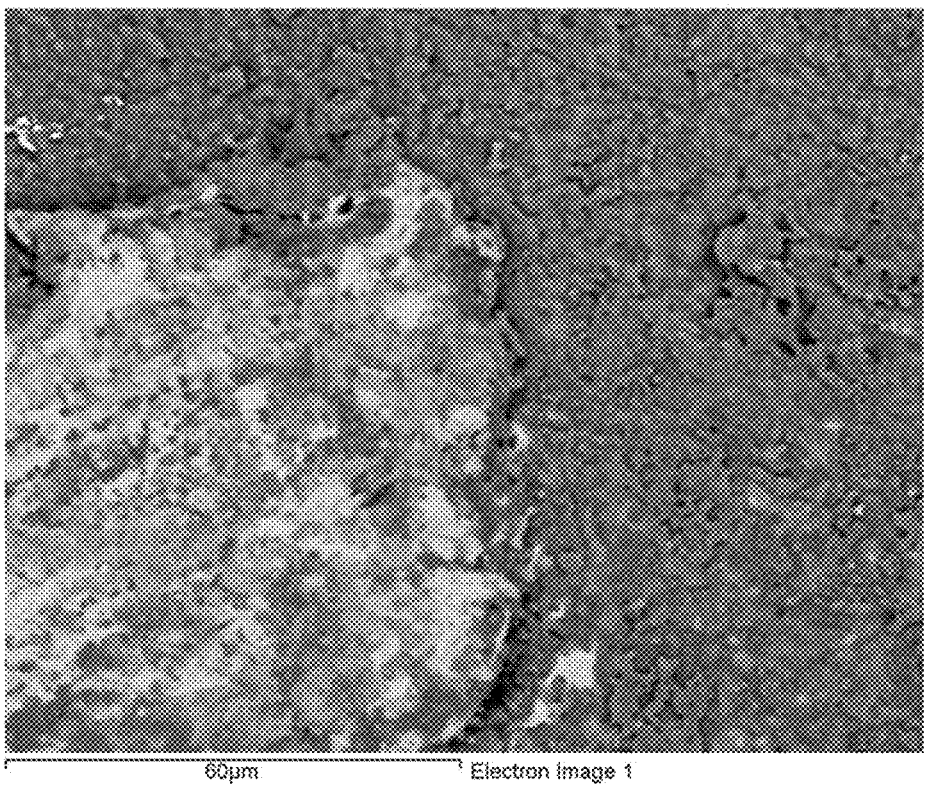
FIG. 3A is a scanning electron micrograph of the edge of an iron mound defect on mill glass coated electrical steel.
Figure 3B:
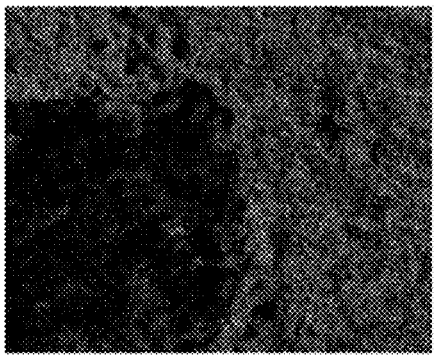
FIG. 3B is a compositional map for magnesium corresponding to the scanning electron micrograph of FIG. 3A.
Figure 3C:
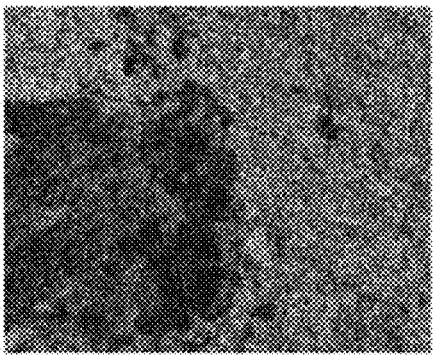
FIG. 3C is a compositional map for silicon corresponding to the scanning electron micrograph of FIG. 3A.
Figure 3D:
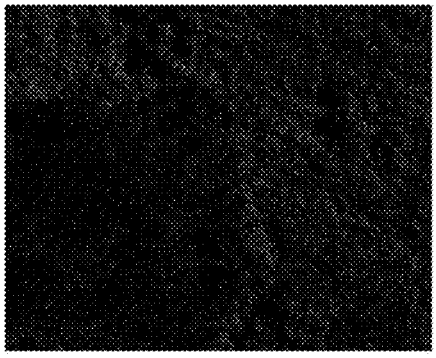
FIG. 3D is a compositional map for oxygen corresponding to the scanning electron micrograph of FIG. 3A.
Figure 3E:
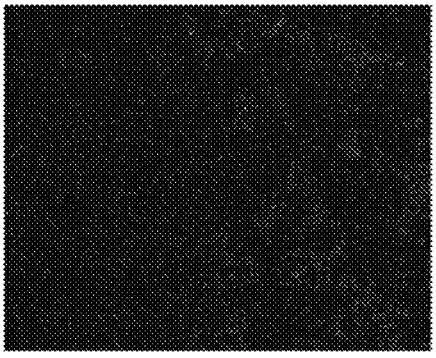
FIG. 3E is a compositional map for manganese corresponding to the scanning electron micrograph of FIG. 3A.
Figure 3F:
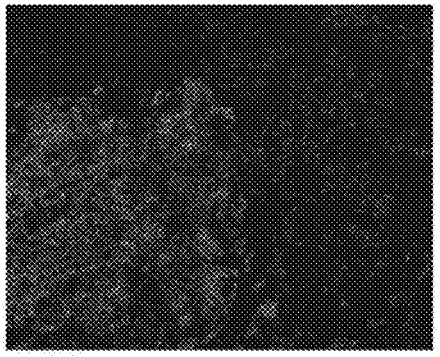
FIG. 3F is a compositional map for iron corresponding to the scanning electron micrograph of FIG. 3A.
Figure 3G:
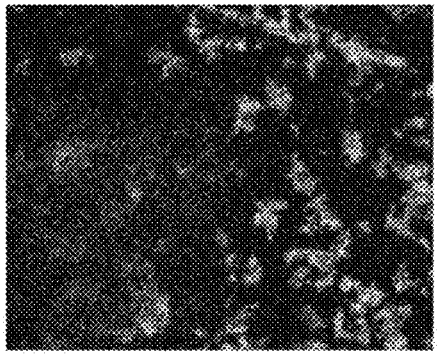
FIG. 3G is a compositional map for sulfur corresponding to the scanning electron micrograph of FIG. 3A.

The reader will appreciate the foregoing details, as well as others, upon considering the following detailed description of certain non-limiting embodiments of methods according to the present disclosure.

DETAILED DESCRIPTION OF CERTAIN NON-LIMITING EMBODIMENTS

It is to be understood that certain descriptions of the embodiments disclosed herein have been simplified to illustrate only those elements, features, steps, and aspects that are relevant to a clear understanding of the disclosed embodiments, while eliminating, for purposes of clarity, other elements, features, steps, and aspects. Persons having ordinary skill in the art, upon considering the present description of the disclosed embodiments, will recognize that other elements, steps, and/or features may be desirable in a particular implementation or application of the disclosed embodiments. However, because such other elements, steps, and/or features may be readily ascertained and implemented by persons having ordinary skill in the art upon considering the present description of the disclosed embodiments, and are therefore not necessary for a complete understanding of the disclosed embodiments, a description of such elements, steps, and/or features is not provided herein. As such, it is to be understood that the description set forth herein is merely exemplary and illustrative of the disclosed embodiments and is not intended to limit the scope of the invention as defined solely by the claims.

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the subject matter according to the present disclosure. At the very least, and not as an attempt to limit the application of the doctrine of equivalents to the scope of the claims, each numerical parameter should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

An aspect of the present disclosure encompasses a method to reduce the height of or eliminate iron mound defects on mill glass coated electrical steel. As used herein, the term "electrical steel" refers to an iron alloy which may have from up to 6.5 percent by weight of silicon as the major alloying element. Commercial alloys usually have silicon content up to 3.2 percent by weight, as higher concentrations of silicon may exhibit brittleness during cold rolling. Manganese and aluminum can be added up to 0.5%. Increasing the amount of silicon inhibits eddy currents and narrows the hysteresis loop of the material, thus lowering the core losses. However, the grain structure hardens and embrittles the metal, which adversely affects the workability of the material, especially when rolling it. When alloying, the concentration levels of carbon, sulfur, oxygen and nitrogen must be kept low, as these elements result in the formation of carbide, sulfide, oxide and nitride particles. These particles, even in particles as small as one micrometer in diameter, increase hysteresis losses while also decreasing magnetic permeability. The presence of carbon has a more detrimental effect than sulfur or oxygen. Carbon also causes magnetic aging when it slowly leaves the solid solution and precipitates as carbides, thus resulting in an increase in power loss over time. For these reasons, the carbon level is kept to 0.005 percent by weight or lower. The carbon level can be reduced by annealing the steel in a decarburizing atmosphere, such as hydrogen.

The term "grain-oriented electrical steels (GOES)" refers to iron-based alloys containing silicon as the major alloying addition, and wherein the GOES sheet is processed so that the crystal grain orientation of the sheet is tightly controlled and the sheet properties are optimized in the rolling direction. GOES sheet are used generally in applications such as power transformers where electrical conductivity and magnetic properties are important. An example of a grain-oriented electrical steel is a very low carbon, approximately 3% silicon-iron alloy, from ATI Allegheny Ludlum, Leechburg, Pa., characterized for its enhanced magnetic properties in a flat-rolled product. Grain-oriented electrical steel is carefully processed to develop optimum magnetic properties of core loss and permeability in the coil rolling direction. Unlike stainless steels, grain-oriented electrical steel products are tested and sold on the basis of their magnetic and electrical properties.

Figure 4:
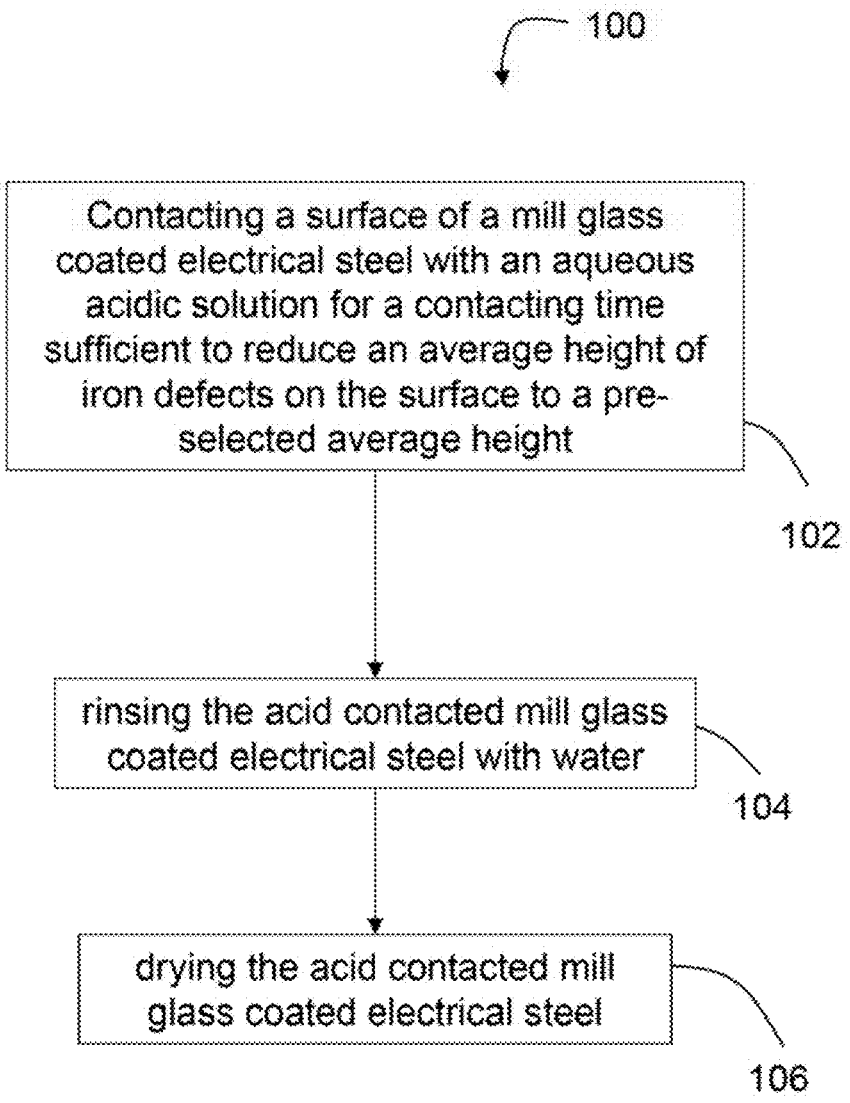
FIG. 4 is a flow chart of a non-limiting embodiment of a method for reducing the height of iron mound defects on mill glass coated electrical steel according to the present disclosure.

Referring to FIG. 4, in one non-limiting embodiment, a method 100 for reducing the height of iron mound defects or reducing the short-circuiting effect of iron mound defects on mill glass coated electrical steel comprises contacting 102 at least a portion of a surface of a mill glass coated electrical steel with an aqueous acidic solution for a time sufficient to reduce an average height of iron mound defects on the surface to no more than a pre-selected height; rinsing 104 the acid contacted portion of the surface with water; and drying 106 the rinsed portion of the surface. In a non-limiting embodiment of a method according to the present disclosure, the pre-selected height is zero, in which case all or substantially all of the iron mound defect material is removed from the treated portions of the surface by the method. In another non-limiting embodiment of a method according to the present disclosure, the pre-selected height is a height equal to or within ±10% of the thickness of the mill glass coating. In still other non-limiting embodiments of a method according to the present disclosure, the pre-selected height is a height in a range of from 0 percent to 150 percent of the thickness of the mill glass coating. In another non-limiting embodiment of a method according to the present disclosure, the pre-selected height is a height in a range of from 0 percent to 100 percent of the thickness of the mill glass coating. In non-limiting embodiments, the thickness of a mill glass coating is in a range of about 0.5 μm to about 20 μm, or about 1 μm to about 10 μm, or about 2 μm to about 5 μm.

In an non-limiting embodiment, a method 100 for reducing the short-circuiting effect of iron mound defects comprises one of dissolving a portion of individual iron mound defects or completely dissolving the iron mound defects by contacting 102 the surface of the mill glass coated electrical steel with an aqueous acidic solution. When a portion of an iron mound defect is remaining on the mill glass coated electrical steel after contacting 102 with an aqueous acidic solution, the topcoat, for example, a monomagnesium phosphate coating, will adhere better to the partially dissolved iron mound and thus decrease or eliminate the need to apply a second top coating. In a non-limiting embodiment, contacting 102 a surface of a mill glass coating dissolves a portion or all of each iron mound defect and does not significantly or effectively remove the mill glass coating. In non-limiting embodiments, the mill glass coating is significantly or effectively removed within the meaning of the present description when conductivity testing, such as Franklin insulation testing, yields high values, e.g. in a range of 0.9-1.0 amperes. This testing is described later herein.

A mill glass surface typically has a Franklin test value of 0.8 or less. In a non-limiting embodiment, contacting 102 with an aqueous acidic solution does not significantly or effectively remove the mill glass coating when the average Franklin test value after contacting 102 is not increased compared with the average Franklin test value of the mill glass surface prior to the step of contacting 102 the mill glass surface with an aqueous acidic solution. In another non-limiting embodiment, contacting 102 with an aqueous acidic solution does not increase the Franklin test value compared with the Franklin test value of the mill glass surface prior to the step of contacting 102 the mill glass surface with an aqueous acidic solution when the Franklin test value is measured at a portion of the mill glass coating that does not contain an iron mound defect. In another non-limiting embodiment, the average Franklin test value of the mill glass surface after contacting 102 with an aqueous acidic solution is equal to or less than 0.8 ampere.

In a non-limiting embodiment, a method of reducing the height of iron mound defects on a mill glass coated electrical steel comprises contacting at least a portion of a surface of a mill glass coated electrical steel with an aqueous acidic solution. In one non-limiting embodiment, the acidic solution comprises at least one oxidizing acid, such as, for example, nitric acid or chromic acid. Another aspect according to the present disclosure comprises contacting at least a portion of a surface of a mill glass coated electrical steel with an acidic solution including an organic acid. Exemplary organic acids include, but are not limited to, carboxylic acids and multifunctional carboxylic acids, such as a tricarboxylic acid, including citric acid, isocitric acid, and aconitic acid.

In certain non-limiting embodiments of a method according to the present disclosure, the acidic solution applied to at least a portion of the mill glass coated electrical steel surface is heated, which will accelerate dissolution of iron mound defects on the portion. In a non-limiting embodiment, the acidic solution is heated to a temperature in a range of 100° F. to 200° F. (37.8° C. to 93.3° C.). In another non-limiting embodiment, the acidic solution is heated to 140° F. (60° C.).

In certain non-limiting embodiments of a method according to the present disclosure wherein the acidic solution comprises nitric acid, the acidic solution comprises 1 percent to 10 percent by volume of a 15.8 molar nitric acid solution in water. In certain non-limiting embodiments according to the present disclosure, a method of reducing the height of iron mound defects on a mill glass coated electrical steel surface comprises contacting at least a portion of the surface with an aqueous nitric acid solution for a time of 5 seconds to 10 seconds.

In certain non-limiting embodiments in which the acidic solution comprises an organic acid, the organic acid concentration in the solution ranges from 2 percent to 30 percent by weight. In certain non-limiting embodiments in which the acidic solution comprises citric acid, the citric acid concentration in the solution is in a range of 4 percent to 20 percent by weight, or 10 percent to 15 percent by weight. In certain non-limiting embodiments wherein the acidic solution comprises 10 percent to 15 percent by weight of citric acid, or 4 percent to 20 percent by weight, at least a portion of a surface of the mill glass coated electrical steel is contacted with the acidic solution for a time in a range of from 5 seconds to 5 minutes, or from 10 seconds to 5 minutes, or from 5 seconds to 20 seconds.

According to one aspect of the present disclosure, the electrical steel is a grain oriented electrical steel (GOES). The two main types of electrical steel are grain-oriented electrical steel (GOES) and non-oriented electrical steel. GOES usually has a silicon level of 3 percent. As noted above, GOES is processed in such a way that optimum properties are developed in the rolling direction, due to tight control of the crystal grain orientation. Controlling grain orientation increases the magnetic flux density by about 30 percent in the coil rolling direction, although the magnetic saturation is decreased by about 5 percent. Non-oriented electrical steel usually includes 2 to 3.5 weight percent silicon and is isotropic in that it exhibits similar magnetic properties in all directions. Non-oriented electrical steel is less expensive and is used in devices in which the direction of magnetic flux is changing during operation, such as in electric motors and generators. Both mill glass coated GOES and mill glass coated non-oriented electrical steels may be treated using the methods according to the presented disclosure to reduce the average height of iron mound defects on surfaces of the steels.

While it is anticipated that embodiments of methods of reducing iron mound defects on electrical steels according to the present disclosure may be applied to any electrical steel, in specific embodiments, GOES alloys that are amenable to treatment using methods according to the present disclosure include, for example, electrical steels as specified in applicable domestic (ASTM A876) and non-domestic (JIS C2553, EN 10107) material specifications. Specific embodiments of non-grain oriented electrical steel alloys that are amenable to treatment using methods according to the present disclosure include, for example, electrical steels as specified in ASTM A677:

In a non-limiting embodiment according to the present disclosure, the mill glass coating on a surface of an electrical steel treated using a method herein comprises forsterite oxide, $Mg_2SiO_4$, in which case the coating may be referred to as forsterite mill glass coating. The forsterite mill glass coating is actually a crystalline insulative coating and not an amorphous glass. As used herein, the term "mill glass coating" refers to a crystalline insulating or insulative coating used on electrical steel to provide an electrically insulating layer on the electrical steel. Other crystalline insulative coatings are known to persons skilled in the art, and are within the scope of the disclosures herein. Electrical steels coated with mill glass coatings including one or more of such other insulative crystalline coatings also may be treated with methods according to the present disclosure so as to reduce the height of iron mound defects on surfaces of such electrical steels, without significantly or effectively removing the forsterite mill glass or other crystalline insulative coating. Accordingly, it will be understood that the applicability of methods according to the present disclosure is not limited to use on electrical steel surfaces coated with forsterite mill glass coating.

A non-limiting embodiment of a method according to the present disclosure for reducing the height of iron mound defects on a mill glass coated electrical steel comprises providing a mill glass coated electrical steel; contacting at least a portion of a surface of the mill glass coated electrical steel with an acidic solution for a time sufficient to reduce an average height of iron mound defects on the portion of surface to no more than a pre-selected average height, wherein the pre-selected average height is in a range of 0 percent to 150 percent of the thickness of the mill glass coating, and wherein contacting with the acidic solution does not significantly or effectively remove the mill glass coating.

In a more specific non-limiting embodiment of a method according to the present disclosure for reducing the height of iron mound defects on a mill glass coated electrical steel, the method comprises contacting at least a portion of a surface of a mill glass coated electrical steel with a citric acid solution including 4 to 20 weight percent citric acid for 5 seconds to 5 minutes to thereby reduce an average height of the iron mound defects on the portion of the surface to a height of 0 percent to 150 percent of the thickness of the mill glass coating, and wherein contacting with the acidic solution does not significantly or effectively remove the mill glass coating.

According to another non-limiting embodiment of a method according to the present disclosure for reducing the height of iron mound defects on a mill glass coated electrical steel, the method, comprises acid treating at least a portion of the surface of a mill glass coated electrical steel with an acidic solution including 4 percent to 20 percent by weight carboxylic acid for a treatment time in a range of 5 seconds to 5 minutes; rinsing the portion of the acid treated mill glass coated electrical steel surface with water; and drying the portion of the rinsed acid treated mill glass coated electrical steel. In a non-limiting embodiment, the carboxylic acid is citric acid.

As used herein, the "height" of an iron mound defect refers to the distance by which the iron mound defect protrudes from the surface of an electrical steel on which the iron mound has formed. As used herein, "rinsing" a surface or portion of a surface refers to any suitable technique for applying a liquid to the surface or surface portion, whether as a liquid spray, stream, or otherwise, and also encompasses placing the surface or surface portion in a bath or tank of the liquid. As used herein, "drying" a surface or surface portion refers to any suitable technique for drying, including, for example, drying in ambient air, drying with a stream of air, and drying by heating the surface to a temperature above ambient temperature. Although the present description refers to treating at least a portion of a surface of a coated electrical steel, it will be understood that such language encompasses treating only a portion of a surface or treating an entire surface, whether in a batch process or in a continuous operation, such as in a line operation including an immersion bath or tank.

Another aspect of the present disclosure includes a method of forming a electrical transformer core. In a non-limiting embodiment, a method of forming an electrical transformer core comprises providing a plurality of GOES strips treated according to the non-limiting embodiments of the present disclosure, and stacking the plurality of electrical steel strips in a conventional E-I manner, as known to those having ordinary skill in the art, to form an EI transformer core. It is understood that other types of transformer cores known to a person skilled in the art, such a R cores and toroidal cores are within the scope of the present disclosure.

In another non-limiting embodiment, a method of forming an electrical transformer core comprises providing a plurality of GOES strips treated according to the non-limiting embodiments of the present disclosure, and winding the plurality of electrical steel strips to form a wound transformer core. The steps of stacking and winding strips to form a transformer core are know to a person having ordinary skill in the art, and therefore do not need to be described herein.

Example 1

Coating defects can be detected using the Franklin electrical insulation test (ASTM Designation A-344-68), which is a conventional testing technique used as a qualification practice to evaluate glass coated electrical steels for many transformer manufacturers. The test measures electrical current leaking through a glass coated electrical steel surface at multiple points along a three inch length, under a specified contact pressure and applied electrical potential. The test result is reported as a "Franklin value" in units of amperes. A perfect electrical insulator has a Franklin value of zero. A perfect electrical conductor has a Franklin value of 1 ampere.

Strip samples (about 1 inch×6 inches) (about 2.54 cm×15.2 cm) were cut from conventional forsterite mill glass coated GOES (scrub material). The strip samples displayed a high density of visible iron mounds (several per square inch of material). Franklin values were determined by the Franklin electrical insulation test. The strip samples were found to exhibit a leakage current of about 0.8 amperes. A value of about 0.8 amperes is generally characteristic of a scrubbed surface.

Example 2

Scrub material strip samples from Example 1 were treated by immersing each strip in one of four different acid solutions for times ranging from 5 seconds to 5 minutes. The acid solutions used to treat the strips were prepared as follows. About 1.5 liters of fresh acid was used for each treatment. ASTM A967, "Standard Specification for Chemical Passivation Treatments/or Stainless Steel Parts", was used as a reference for the acid concentrations. 10 percent and 25 percent (by volume) nitric acid solutions were prepared by mixing standard 15.8 molar nitric acid with deionized water. 10 percent and 15 percent (by weight) citric acid solutions were prepared by dissolving citric acid in deionized water. The acid solutions were maintained at about 140° F. (60° C.) for the treatments. The strip samples were immersed in an acid solution, removed from the acid solution on completion of the desired immersion time, and rinsed with running cold water. After rinsing, both sides of each strip sample were brushed lightly with a soft bristle brush, immersed in denatured alcohol to displace any water, and allowed to air dry.

Figure 5:
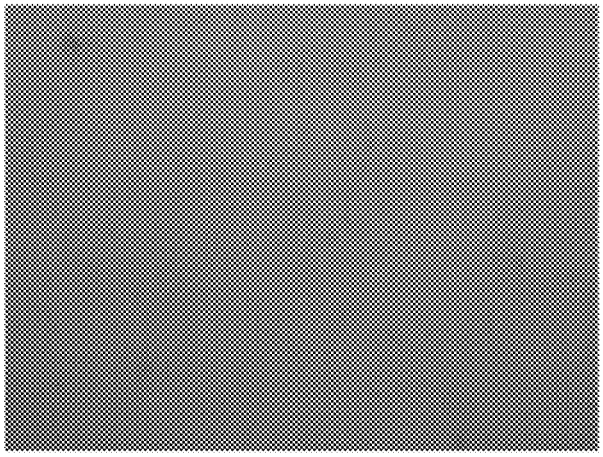
FIG. 5 is a photograph of a surface of a mill glass coated GOES.
Figure 6A:
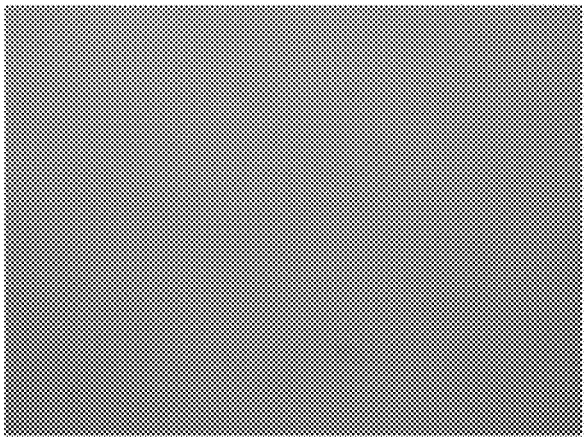
FIG. 6A is a photograph of a surface of a mill glass coated GOES after treatment for 5 seconds in 10 percent by volume nitric acid solution.
Figure 6B:
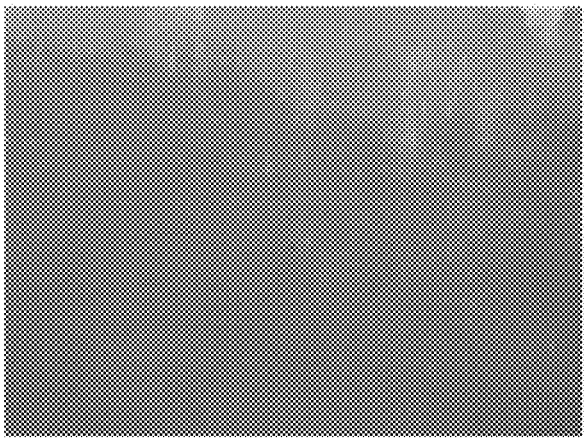
FIG. 6B is a photograph of a surface of a mill glass coated GOES after treatment for 10 seconds in 10 percent by volume nitric acid solution.

FIG. 5 is a black and white photograph representative of the surface of the original scrub material. The photograph of FIG. 5 show a smooth featureless surface. Surface photographs of scrub material contacted with (immersed in) 10 percent nitric acid solution for 5 seconds and 10 seconds are shown in FIGS. 6A and 6B, respectively. When the scrub material was immersed in the 10 percent nitric acid solution, bubbling was observed. When the scrub material was immersed in 10 percent nitric acid for 5 seconds (FIG. 6A), the mill glass turned a lighter shade of grey than the original scrub material, indicating that some of the mill glass was removed. After a 10 second immersion in 10 percent nitric acid, damage to the mill glass at the edges of the sample was observed (FIG. 6B)

Figure 7A:
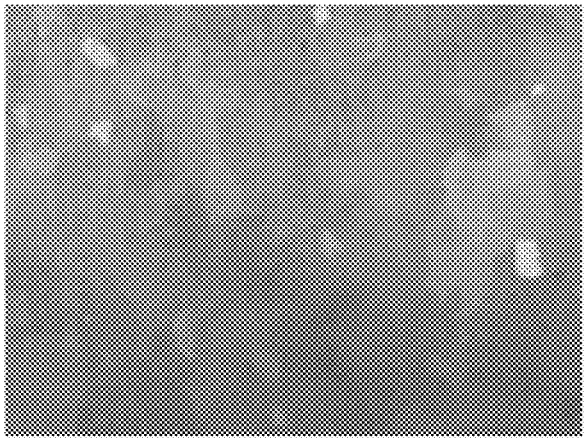
FIG. 7A is a photograph of a surface of a mill glass coated GOES after treatment for 10 seconds in 25 percent by volume nitric acid solution.
Figure 7B:
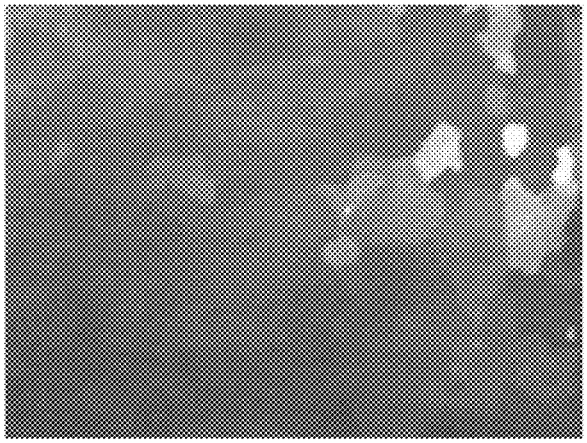
FIG. 7B is a photograph of a surface of a mill glass coated GOES after treatment for 20 seconds in 25 percent by volume nitric acid solution.

Scrub material strip samples also were immersed in 25 percent nitric acid for 10 seconds and 20 seconds. FIG. 7A is a photograph of a strip sample after the second immersion. FIG. 7B is a photograph of a sample after the 20 second immersion. It is evident from FIGS. 7A and 7B that immersion of the scrub material in 25 percent nitric acid for 10 seconds or longer completely removed the mill glass from the GOES material and, therefore, is not suitable for removing iron mound defects from the samples.

Figure 8A:
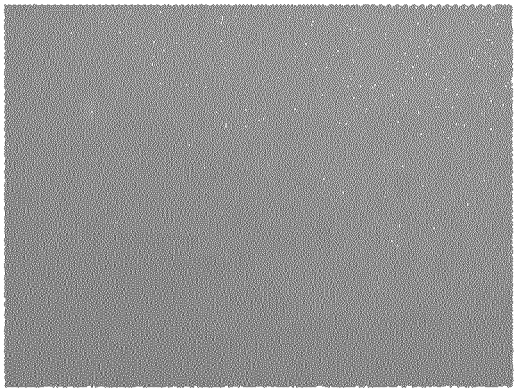
FIG. 8A is a photograph of a surface of a mill glass coated GOES after treatment for 10 seconds in 10 percent by weight citric acid solution.
Figure 8B:
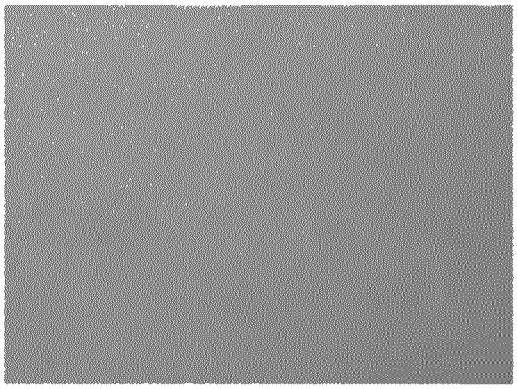
FIG. 8B is a photograph of a surface of a mill glass coated GOES after treatment for 20 seconds in 10 percent by weight citric acid solution.
Figure 8C:
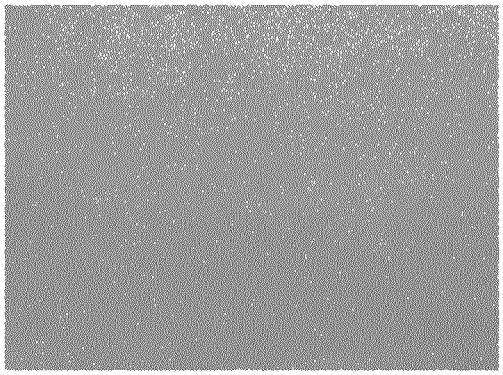
FIG. 8C is a photograph of a surface of a mill glass coated GOES after treatment for 5 minutes in 10 percent by weight citric acid solution.

Scrub material strip samples were immersed in 10 percent citric acid for 10 seconds, 20 seconds, and 5 minutes. Photographs of surfaces of the samples after the 10 second, 20 second, and 5 minute immersion times are provided in FIGS. 8A, 8B, and 8C, respectively. No bubbles were observed from the scrub material immersed in the 10 percent citric acid solution. The surfaces remain relatively featureless, indicating that that mill glass is not effectively damaged or removed. The citric acid treated samples had a lighter grey color than the untreated scrub material.

Figure 9A:
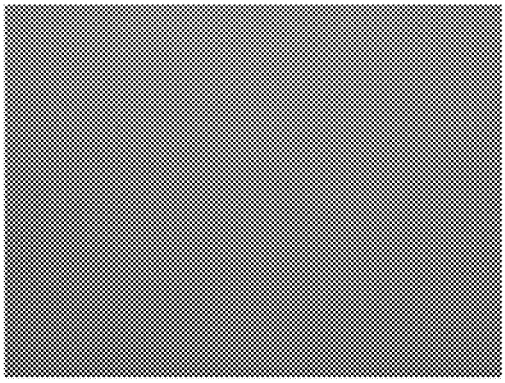
FIG. 9A is a photograph of a surface of a mill glass coated GOES after treatment for 10 seconds in 15 percent by weight citric acid solution.
Figure 9B:
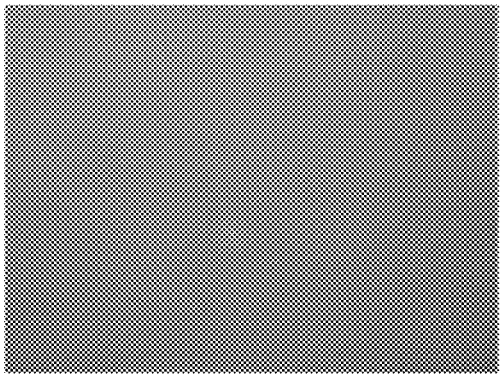
FIG. 9B is a photograph of a surface of a mill glass coated GOES after treatment for 20 seconds in 15 percent by weight citric acid solution.

Scrub material strips sample were immersed in 15 percent citric acid for 10 seconds and for 20 seconds. Photographs of the surfaces immersed for 10 seconds and 20 seconds are found in FIGS. 9A and 9B, respectively. No bubbles were observed from the scrub material immersed in the 10 percent citric acid solution. The surfaces remain relatively featureless, indicating that that mill glass is not effectively damaged or removed. The citric acid treated samples had a lighter grey color than the untreated scrub material.

It was observed that a general effect of immersion in the citric acid solutions, and of immersion for short times in the low concentration nitric acid solution (10 volume percent for 5 seconds), is to brighten the surfaces somewhat and make the surfaces more uniform in color. It is believed that the brightening is a result of cleaning the surface. Visual examination of the surfaces after immersion in the citric acid solutions, and for short times in the low concentration nitric acid solution (10 volume percent for 5 seconds), indicated that the iron mounds became much less visible after treatment, appearing as small dark spots rather than the bright protrusions noted before treatment.

The samples did not effervesce in the citric acid solutions. The 25 percent nitric acid solution, however, was very aggressive. Vigorous bubbling started at the sample surface and the mill glass began to dissolve immediately. A similar effect began to occur after samples were immersed for 20 seconds in the 10 percent nitric acid solution. The dissolution of the mill glass on samples immersed in the nitric acid solutions was unexpected as the mill glass is already in the form of a stable oxide. While not wishing to be bound by any particular theory, it is possible that the following side reaction may have occurred between nitric acid and magnesium oxide (a component of the forsterite glass) to form a stable magnesium nitrate compound.

$$2HNO_3+MgO \rightarrow Mg(NO_3)_2+H_2O$$

Example 3

Figure 10A:
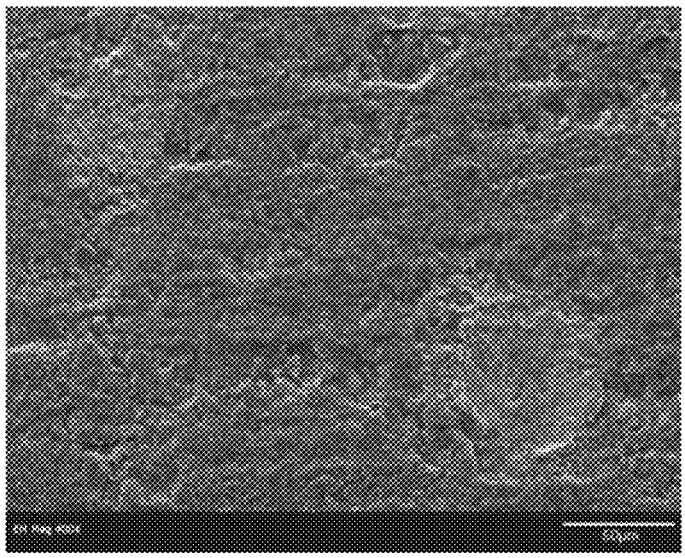
FIGS. 10A and 10B are scanning electron micrographs of a surface of a mill glass coated GOES after treatment for 10 seconds in 10 percent by weight citric acid solution.
Figure 10B:
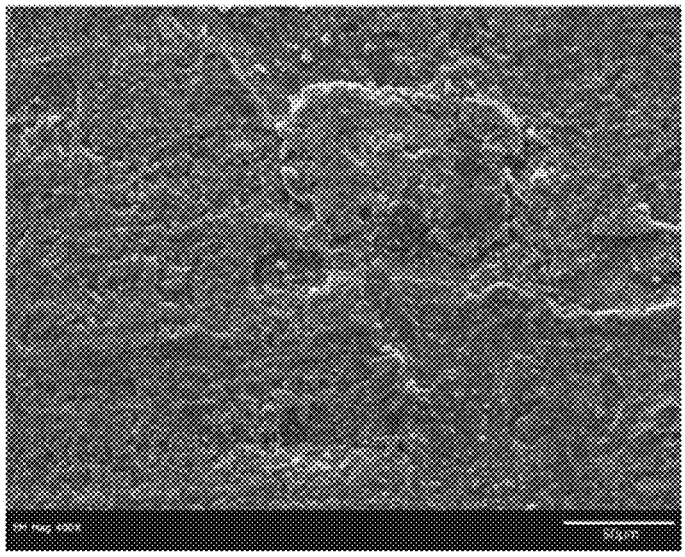
Figure 10C:
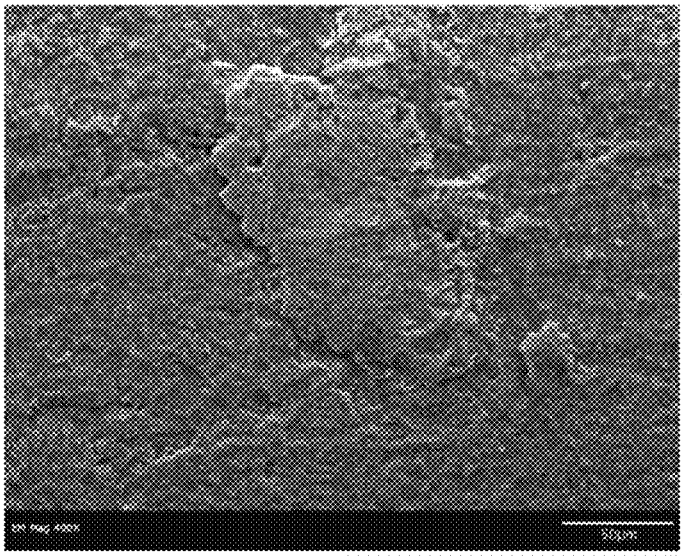
FIGS. 10C and 10D are scanning electron micrographs of a surface of a mill glass coated GOES after treatment for 10 seconds in 10 percent by weight citric acid solution.
Figure 10D:
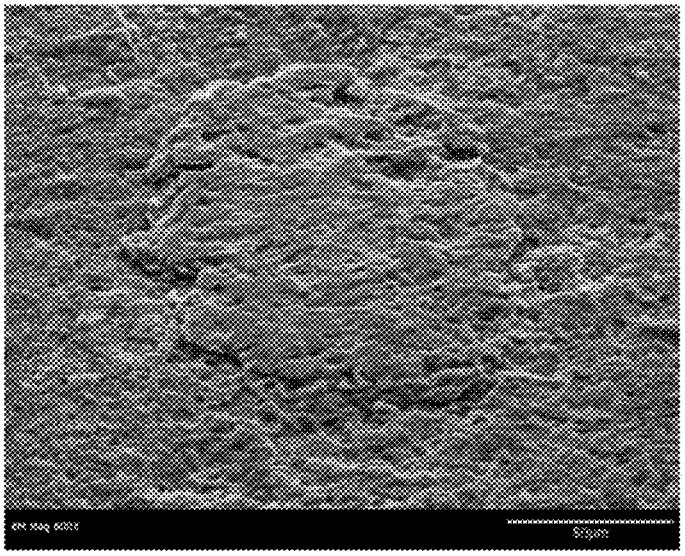

Small samples were cut from each of the strip samples treated in Example 2 and the iron mounds on the strips' surfaces were examined in the SEM. The effect of the 10 percent citric acid solution is shown in the micrographs of FIGS. 10A and 10B for 10 second immersions, and in FIGS. 10C and 10D for 20 second immersions. Examination of FIGS. 10A-10D shows that the iron mounds were attacked significantly by the citric acid solution. The treated iron mounds took on a porous appearance, and many, but not all, of the iron mounds were significantly reduced in size and height by the acid treatment.

Figure 11A:
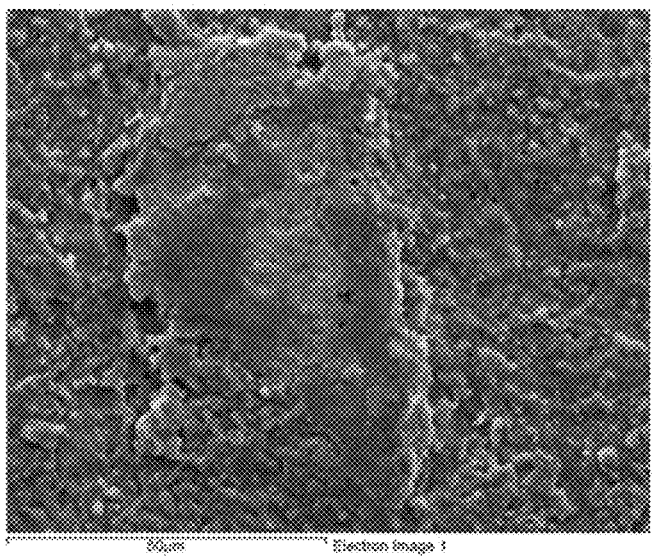
FIG. 11A is a secondary electron scanning electron micrograph of an iron mound defect on a surface of a mill glass coated electrical steel after treatment for 10 seconds with 15 percent by weight citric acid solution.
Figure 11B:
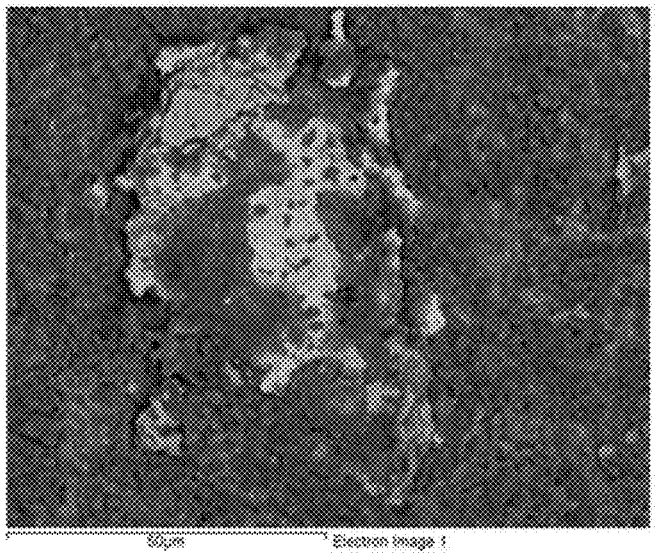
FIG. 11B is a back scattered electron scanning electron micrograph of an iron mound defect on a surface of a mill glass coated electrical steel after treatment for 10 seconds with 15 percent by weight citric acid solution.
Figure 11C:
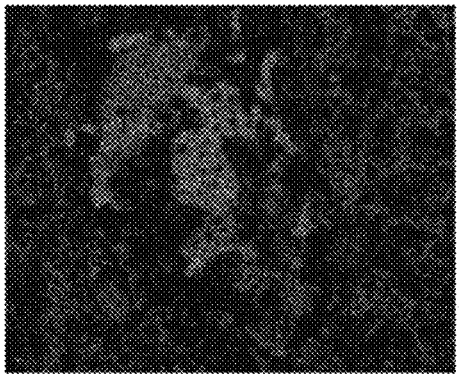
FIG. 11C is a compositional map for iron corresponding to the scanning electron micrographs of FIGS. 11A and 11B.
Figure 11D:
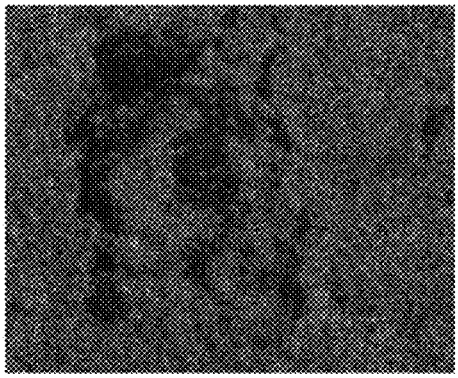
FIG. 11D is a compositional map for silicon corresponding to the scanning electron micrographs of FIGS. 11A and 11B.
Figure 11E:
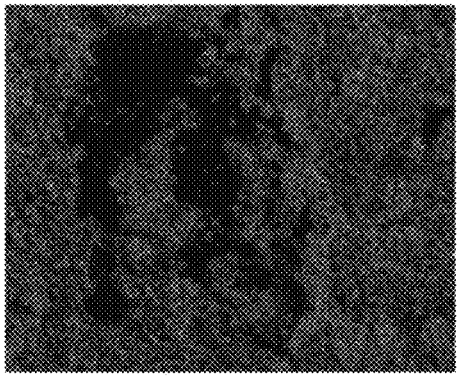
FIG. 11E is a compositional map for magnesium corresponding to the scanning electron micrographs of FIGS. 11A and 11B.
Figure 11F:
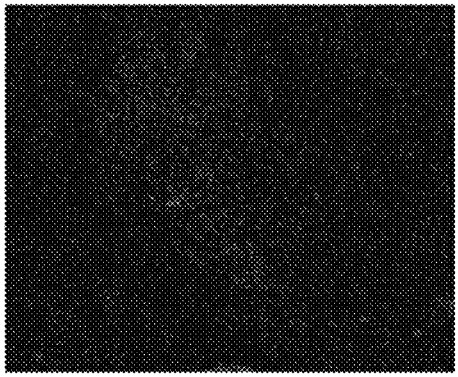
FIG. 11F is a compositional map for sulfur corresponding to the scanning electron micrographs of FIGS. 11A and 11B.
Figure 11G:
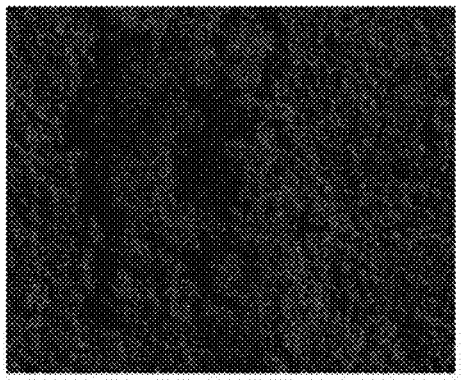
FIG. 11G is a compositional map for oxygen corresponding to the scanning electron micrographs of FIGS. 11A and 11B.

Increasing the citric acid concentration to 15 percent by weight resulted in more aggressive attack of the iron mounds. Secondary electron and backscattered scanning electron micrographs of a residual iron mound on a sample of scrub material that was immersed for 10 seconds in the 15 percent citric acid solution are presented in FIGS. 11A and 11B, respectively. The appearance of the iron mound after treatment in the backscattered image (FIG. 11B) and the lack of brightness in the entire iron mound region suggest that significant portions of iron were removed from the iron mound during treatment for 10 seconds in 15 percent citric acid solution. X-ray maps of the iron mound remnants remaining after immersion in 15 percent citric acid for 10 seconds are presented in FIGS. 11C through 11G. Analysis of FIGS. 11A through 11G shows that the remaining structure of the mounds consists of some metallic iron (FIG. 11C) with a large amount of embedded oxide particles (FIG. 11G). Most of the sulfur (FIG. 11F) in the iron mound was removed by the acid treatment. A small amount of sulfur remained present on the iron mound, but no sulfur was detected in the surrounding mill glass.

Figure 12A:
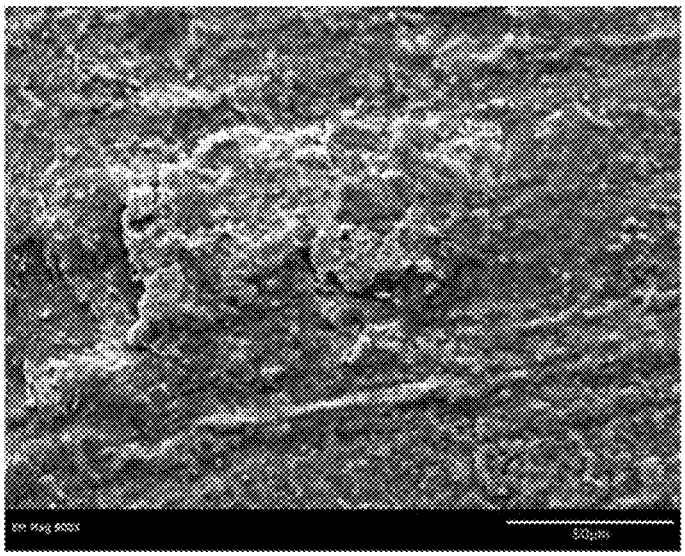
FIG. 12A is a scanning electron micrograph of an iron mound on a surface of a mill glass coated electrical steel after treatment for 20 seconds with 15 percent by weight citric acid solution.
Figure 12B:
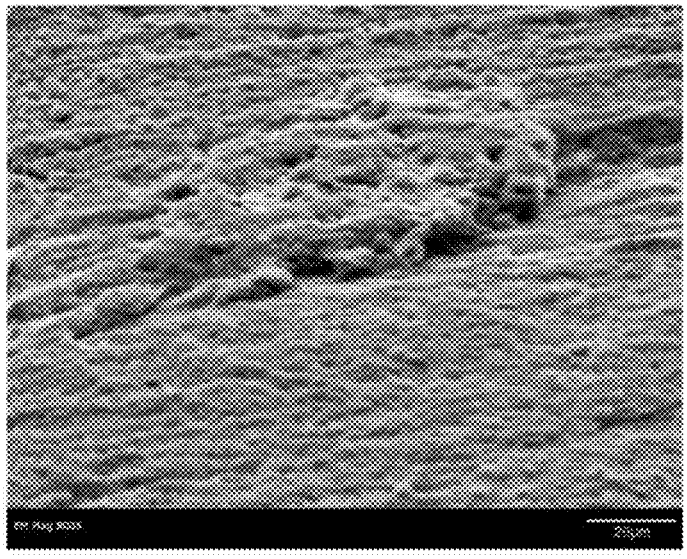
FIG. 12B is a scanning electron micrograph of the iron mound shown in FIG. 12A with the sample tilted at 80°.
Figure 12C:
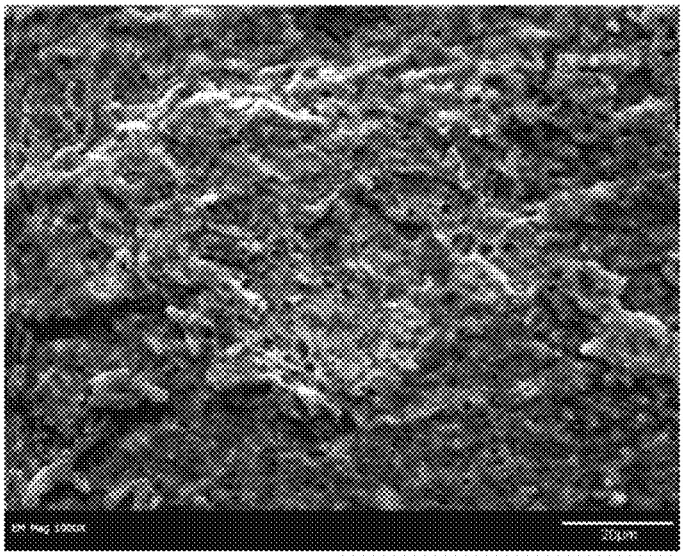
FIG. 12C is a scanning electron micrograph of an iron mound on a surface of a mill glass coated electrical steel after treatment for 20 seconds with 15 percent by weight citric acid solution.
Figure 12D:
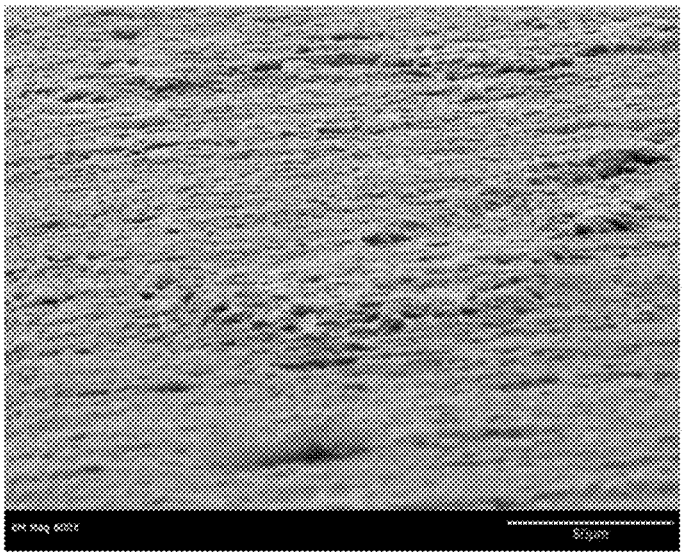
FIG. 12D is a scanning electron micrograph of the iron mound shown in FIG. 12C with the sample tilted at 80°.

The dissolution of the iron mounds progressed with increasing immersion time in the citric acid solution. This is evident by comparing FIGS. 12A and 12B, which are secondary electron imaging scanning electron micrographs of iron mounds treated in 15 percent citric acid for 20 seconds, with FIG. 11A, which is a secondary electron imaging scanning electron micrograph of iron mounds treated in 15 percent citric acid for 10 seconds. The micrographs in FIGS. 12B and 12D were taken with the samples of FIGS. 12A and 12C, respectively, tilted to 80° in the SEM to provide a better view of the height of the iron mound defects remaining after citric acid treatment.

Example 4

Figure 13A:
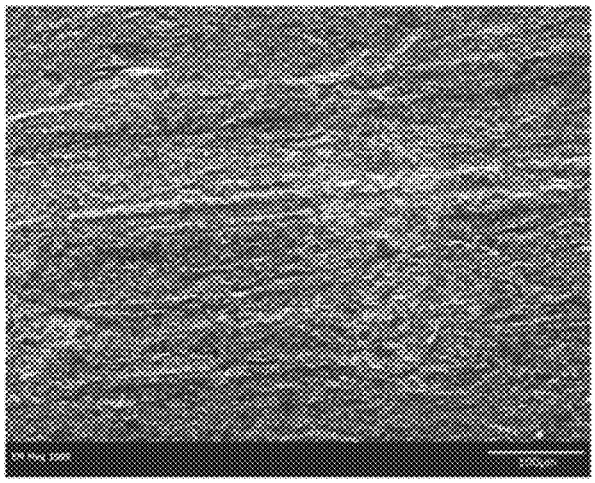
FIGS. 13A and 13B are scanning electron micrographs of iron mounds on a surface of a mill glass coated electrical steel after treatment for 5 seconds with 10 percent by volume nitric acid solution.
Figure 13B:
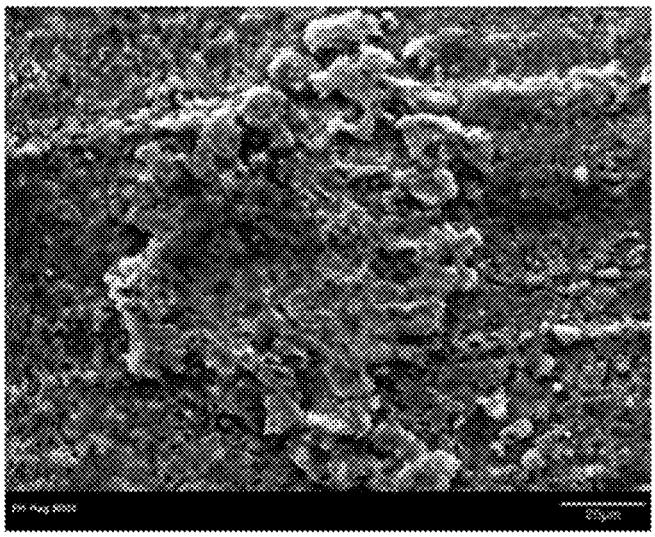
Figure 13C:
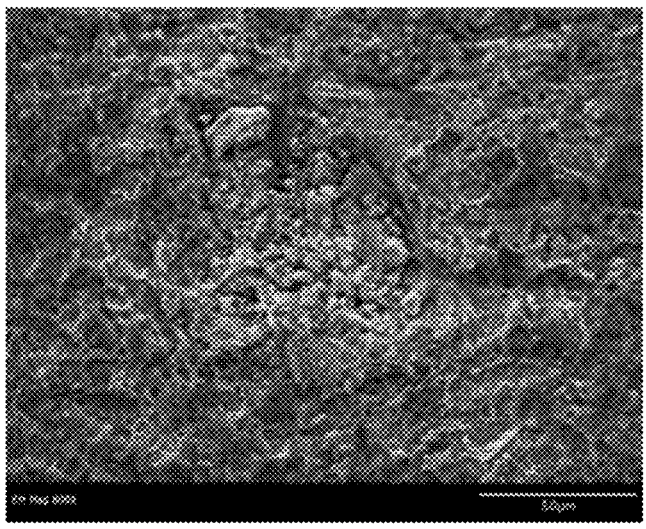
FIGS. 13C and 13D are scanning electron micrographs of iron mounds after treatment for 10 seconds with 10 percent by volume nitric acid solution.
Figure 13D:
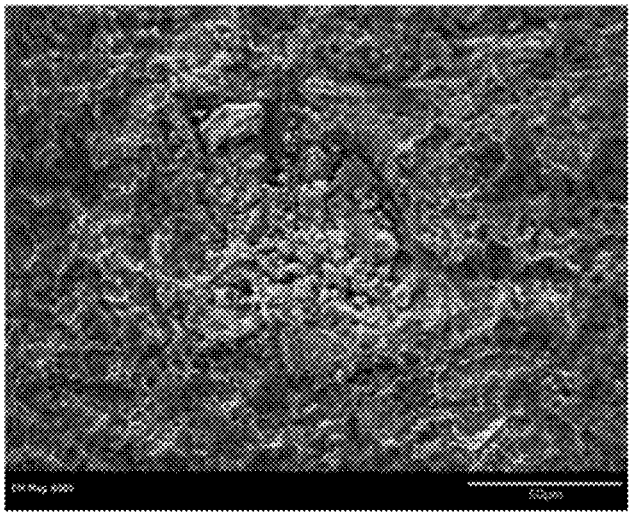

The strip samples that were immersed in nitric acid solution were not studied in great detail because it was observed that the mill glass was not fully resistant to the effects of the nitric acid solution. Nevertheless, iron mounds were also attacked by the nitric acid solution. FIGS. 13A and 13B are scanning electron micrographs of scrub material treated with 10 percent by volume nitric acid solution for 5 seconds. FIGS. 13C and 13D are scanning electron micrographs of scrub material treated with 10 percent by volume for 10 seconds. The iron mounds in FIGS. 13A-D appear to have been attacked to a greater degree in the nitric acid solution than samples immersed for like times in similarly concentrated citric acid solutions.

Example 5

Samples of forsterite mill glass coated GOES having a size of approximately 2"×6" were treated by immersion in a 15 percent citric acid aqueous solution at 140° F. (60° C.) for five minutes. After immersion the samples were rinsed thoroughly in running water, scrubbed with a soft bristle brush, and then dipped in denatured alcohol, followed by drying in hot air. It was visually observed that the test samples' surfaces initially included numerous iron mounds. The samples were then evaluated for current leakage using the Franklin insulation test, according to ASTM Designation A-344-68.

Figure 14:
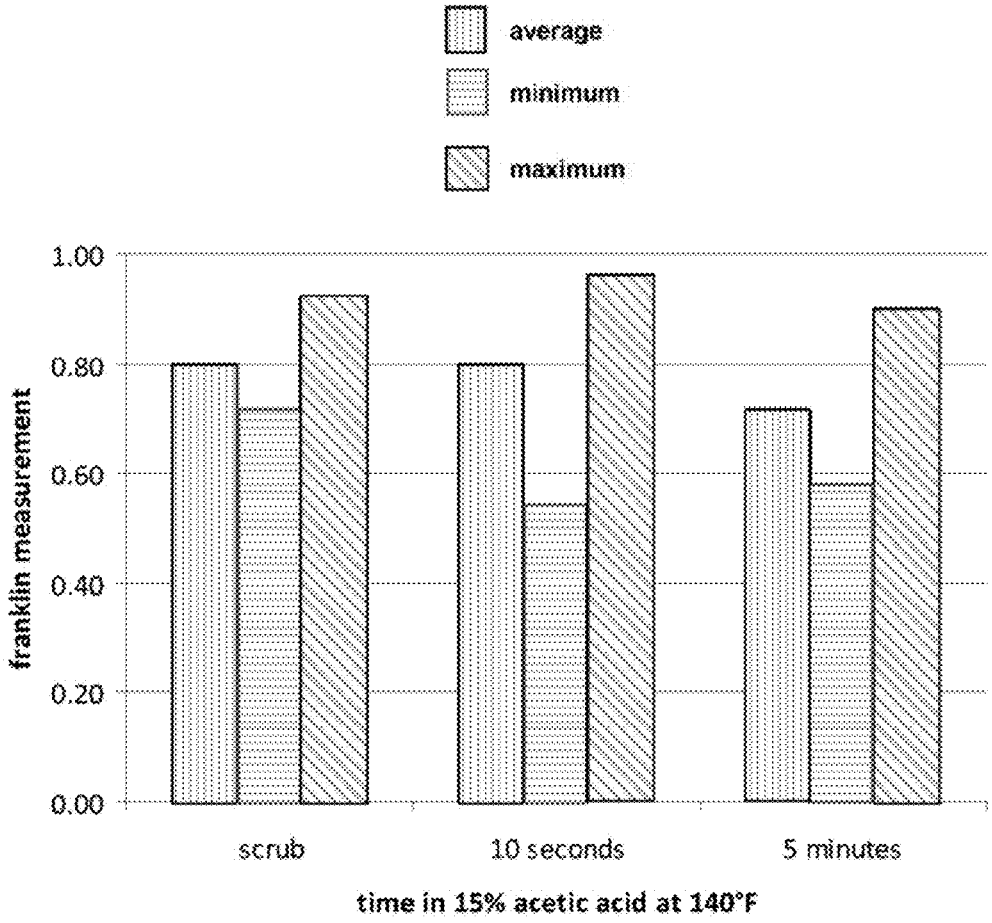
FIG. 14 is a graph of results of Franklin insulation tests for scrub material treated in 15 percent by weight acetic acid aqueous solution at 140° F. (60° C.) for various times.
Figure 15A:
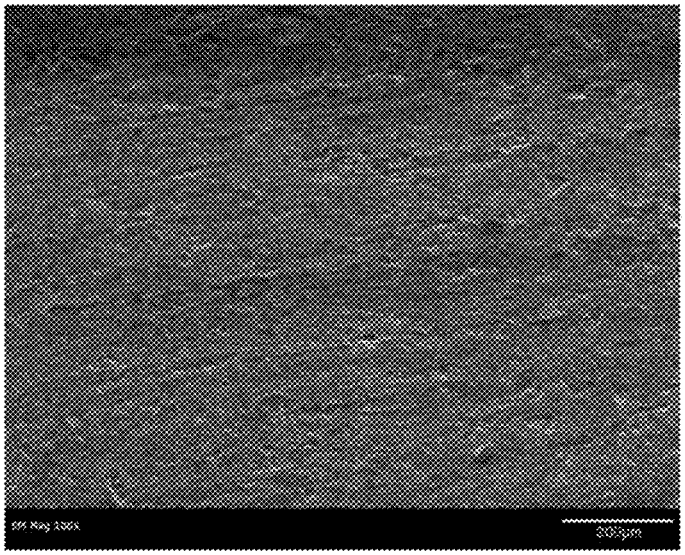
FIGS. 15A through 15D are scanning electron micrographs of a typical mill glass.
Figure 15B:
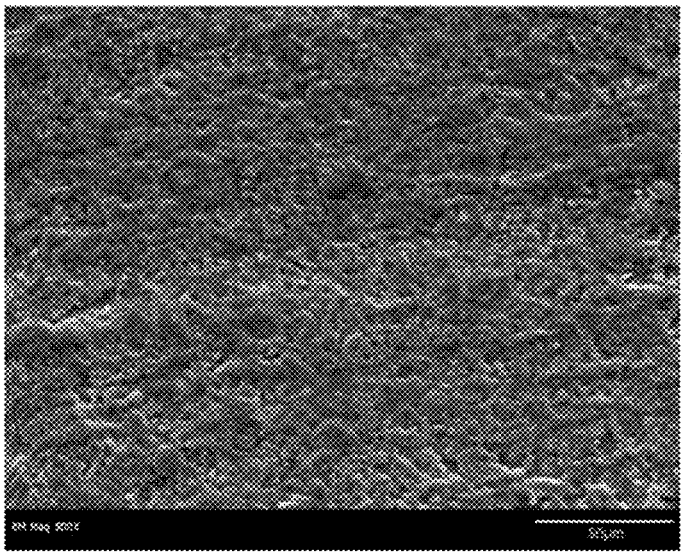
Figure 15C:
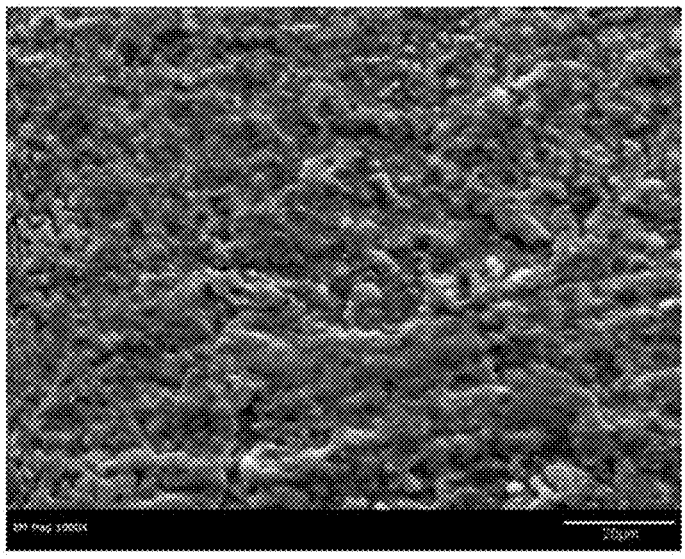
Figure 15D:
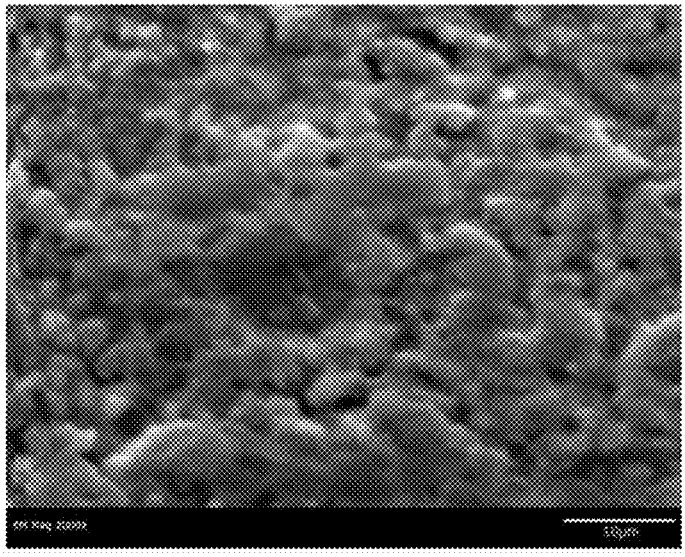

Prior to treatment, the sample material had a relatively high Franklin test average current value, as seen in FIG. 14. Samples were immersed in the acid solution for 10 seconds to simulate a possible mill-scale process time. Other samples were immersed in the acid solution for five minutes to simulate a worst-case scenario in which a line stop occurs on a continuous coil treatment line and material remains immersed in the acid solution for several minutes. FIG. 14 shows the average Franklin test results, along with maximum and minimum recorded values, for the scrub material and for material immersed for the two immersion times. Both acid treated samples exhibited a considerably lower minimum Franklin test value, although the maximum recorded values for all samples were similar. Both of the treated samples exhibited a slightly lower minimum Franklin value than the scrub sample, and show trends for decreasing average and maximum Franklin values. It appears that even with a lengthy immersion time of five minutes, this particular treatment does not damage the mill glass coating in terms of measured electrical conductivity.

Example 6

The forsterite mill glass coating on GOES also was analyzed to provide a reference for the effect of the acid treatment on prime quality areas, which make up the majority of the GOES sheet surface. FIGS. 15A through 15D show a magnification series in the SEM. The mill glass is rough on a microscopic scale and has darker spots scattered on a lighter field.

Figure 16A:
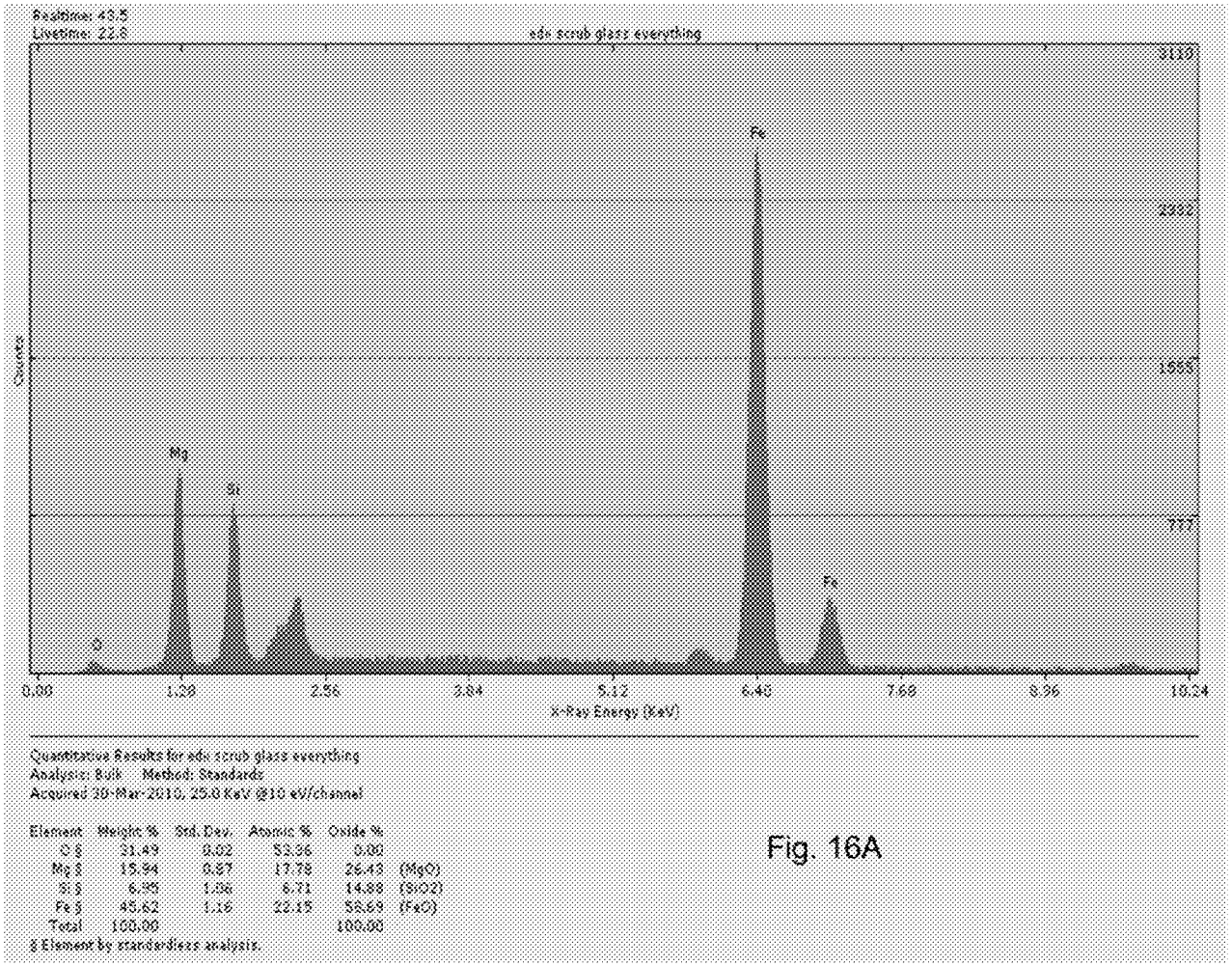
FIGS. 16A through 16C, respectively, are plots presenting results from scanning electron microscopy micro-chemical analysis of a typical mill glass, a localized dark region of a mill glass, and a localized lighter region of a mill glass, respectively.
Figure 16B:
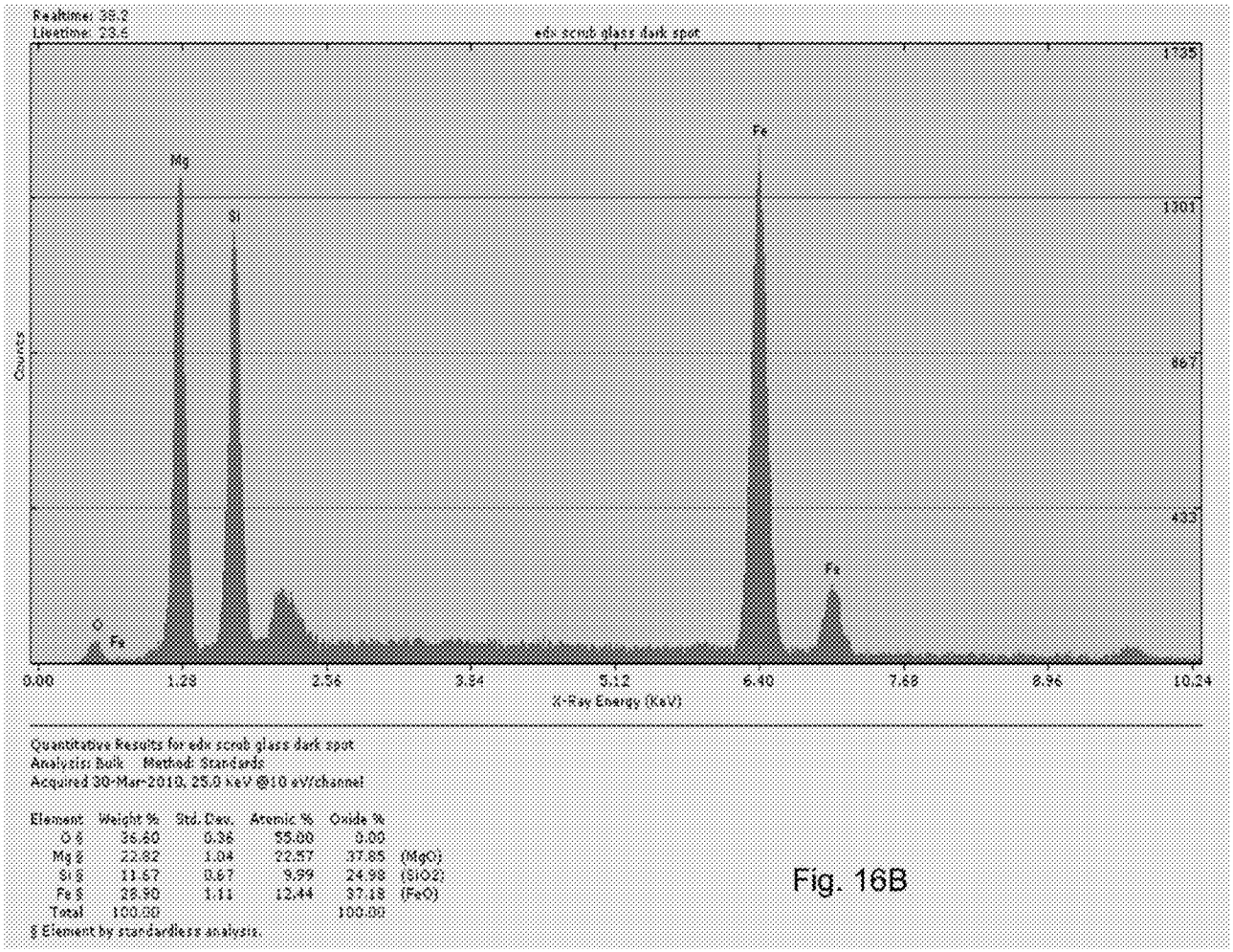
Figure 16C:
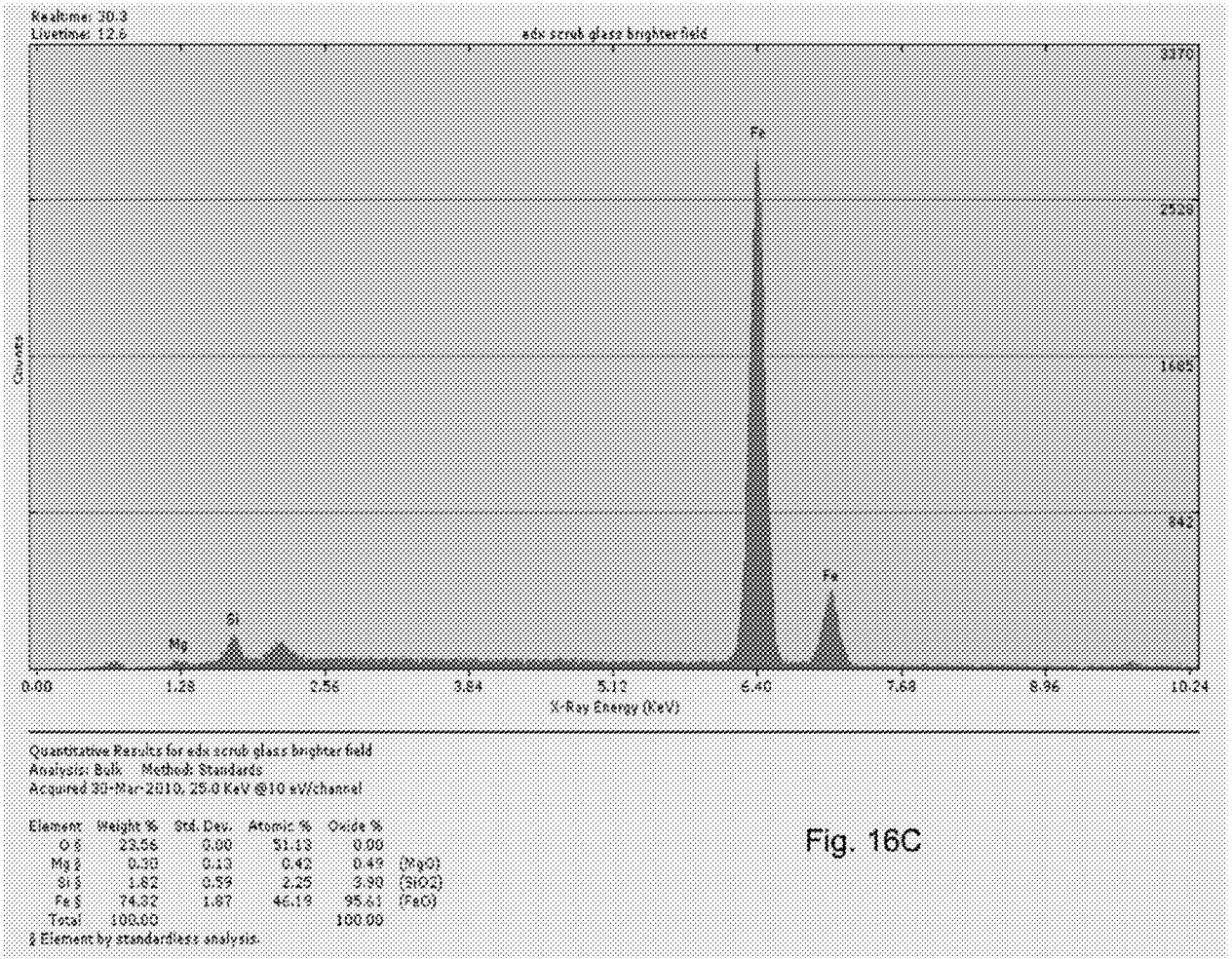

The micro-chemical analysis system in the SEM was used to analyze the glass chemistry. This is not an exact method because the GOES sheet under the mill glass contributes a strong signal, but this method provides a way to compare the mill glass before and after acid cleaning. FIG. 16A shows the overall glass composition, and results from analyzing light areas (FIG. 16B) and dark areas (FIG. 16C) in the glass. The magnesium to silicon ratio is very close to $2MgO.SiO_2$, as expected from a forsterite layer. There is a strong iron signal, most of which likely originates from the steel. The darker regions are richer in magnesium and silicon relative to iron, but the ratio of magnesium to silicon in the spectrum is the same as the overall glass, indicating that the dark regions are likely just thicker areas of mill glass. The brighter, thinner regions are very rich in iron and include more silicon than magnesium, suggesting that these regions are covered with a very thin oxide and the signal mostly originates from the steel.

Figure 17:
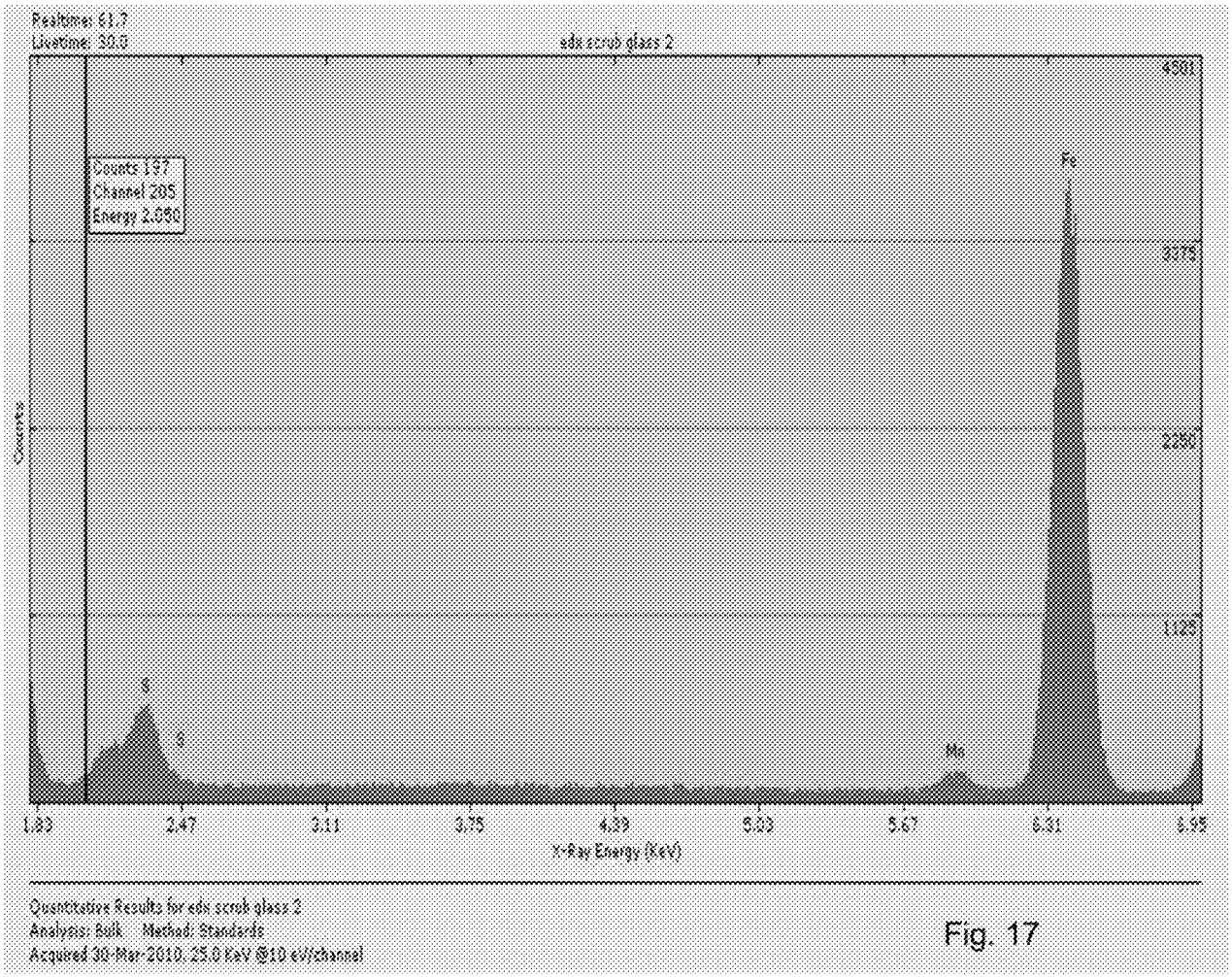
FIG. 17 is a plot presenting results from scanning electron microscopy micro-chemical analysis of a typical mill glass, highlighting peaks for manganese and sulfur.

An SEM micro-chemical analysis of typical mill glass highlighting peaks for manganese and sulfur is presented in FIG. 17. There is a small but notable signal for manganese, suggesting that the remains of the MnS inhibitor particles are concentrated at the interface between the glass and the metal during the tunnel furnace anneal. A much larger signal for sulfur likely originates from the remains of the magnesium sulfate (Epsom salt) added to the MgO powder.

Figure 18:
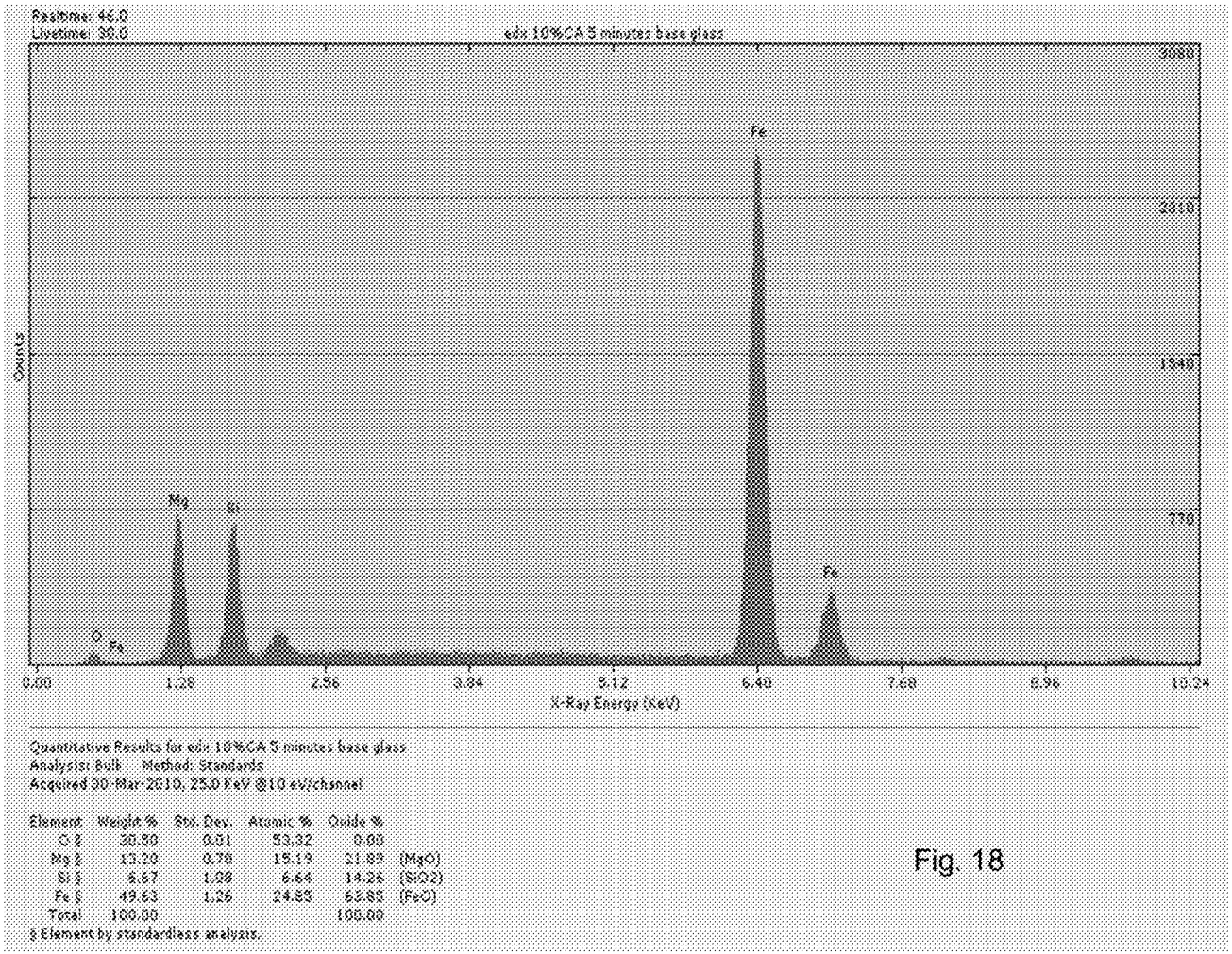
FIG. 18 is a plot presenting results from scanning electron microscopy micro-chemical analysis of a typical mill glass after treatment for 5 minutes in a 10 percent by weight citric acid solution.
Figure 19A:
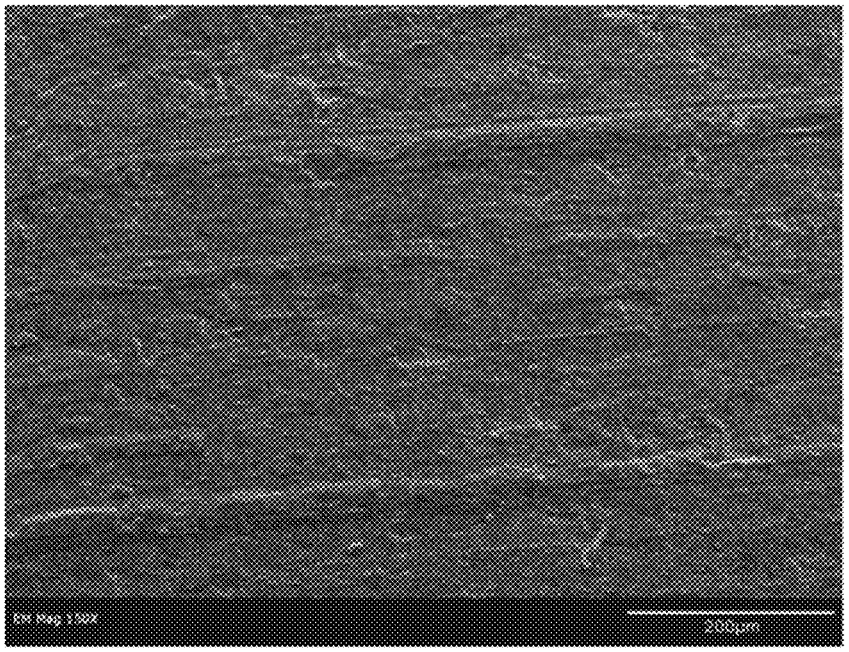
FIGS. 19A through 19D are scanning electron micrographs of mill glass before treatment with an acidic solution.
Figure 19B:
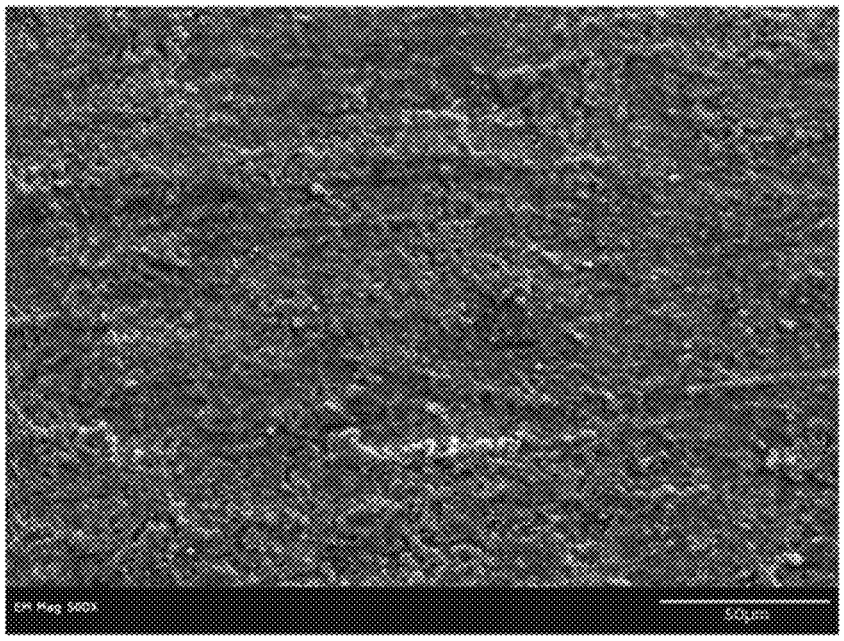
Figure 19C:
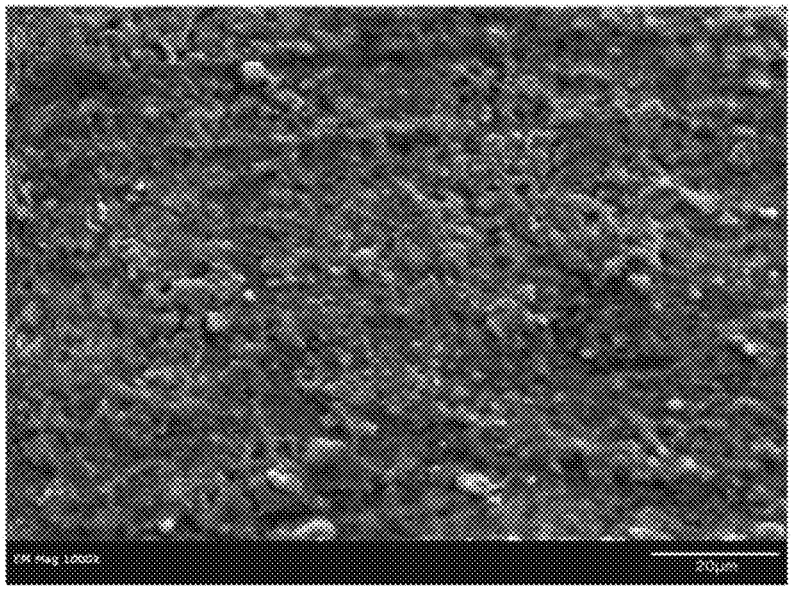
Figure 19D:
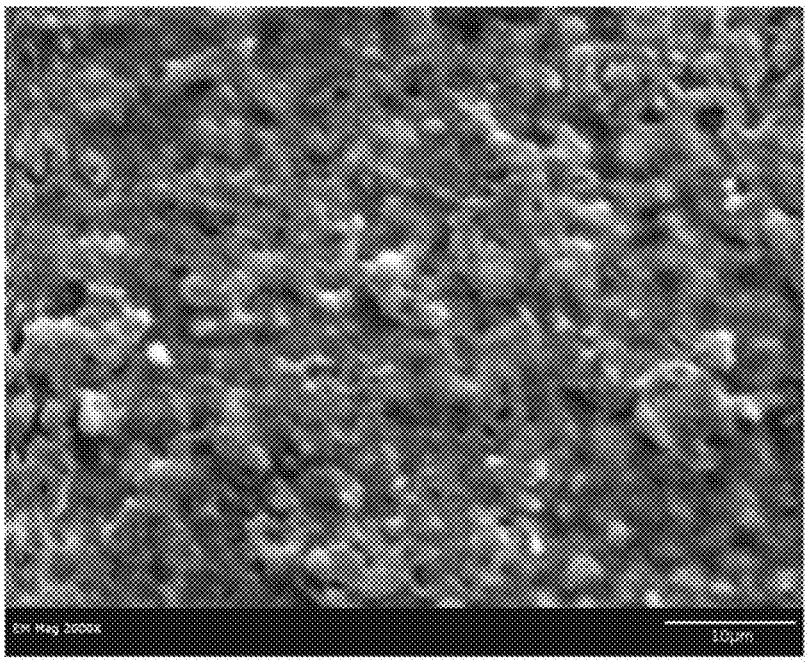
Figure 19E:
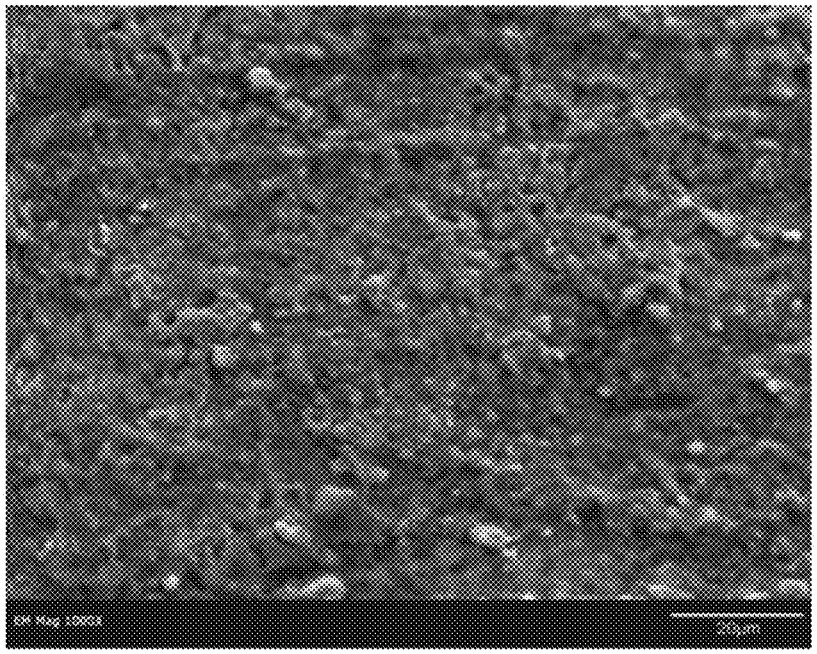
FIGS. 19E through 19H are scanning electron micrographs of mill glass after treatment for 10 seconds in 10 percent by weight citric acid solution.
Figure 19F:
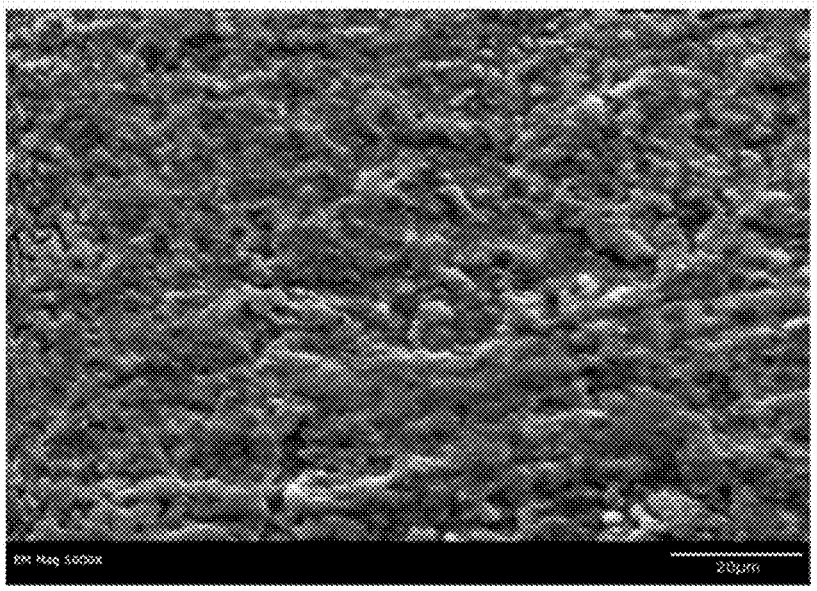
Figure 19G:
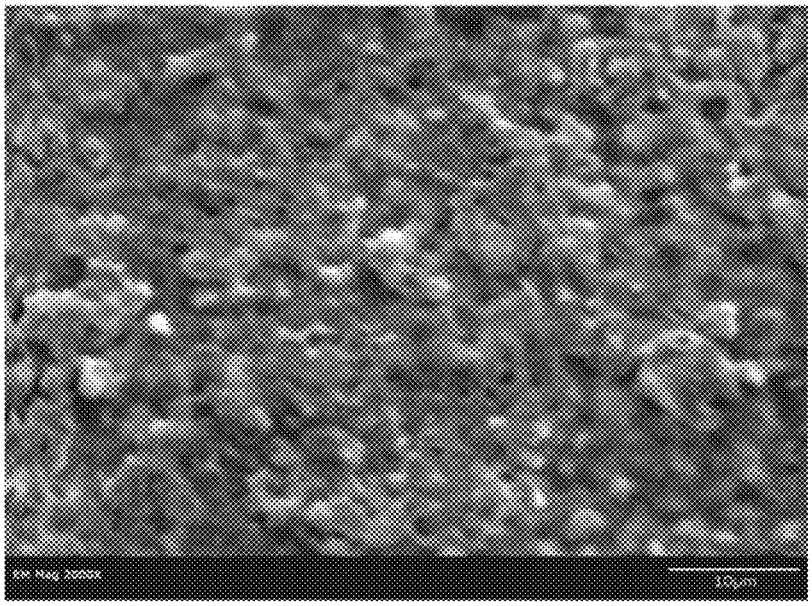
Figure 19H:
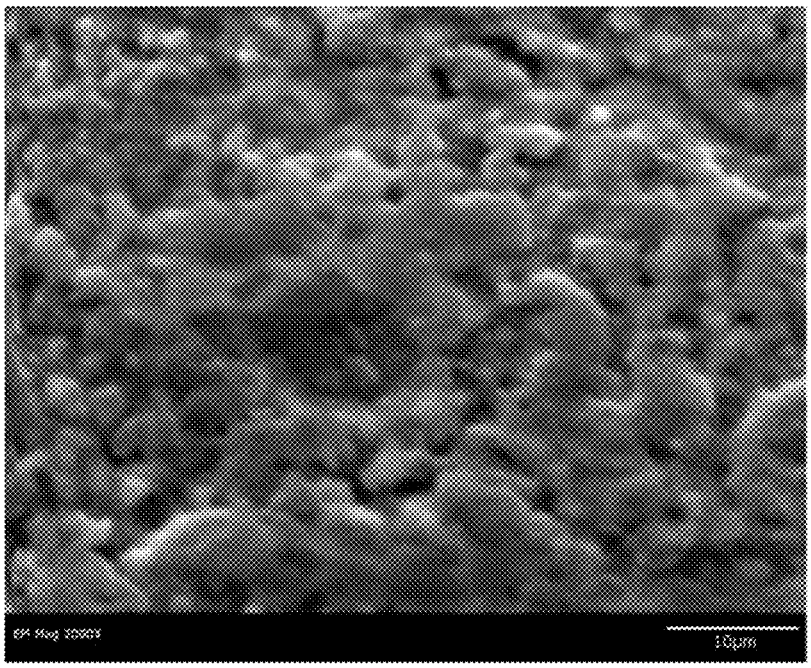

The sample exposed to 10 percent citric acid for 5 minutes was examined in the SEM to determine whether any chemical or structural changes occurred in the mill glass during a prolonged exposure. The X-ray spectrum of the sample is shown in FIG. 18. Sulfur and manganese peaks are not present in the X-ray spectrum presented in FIG. 18. Otherwise, the glass appears to have been relatively unchanged chemically, with the oxide retaining a magnesium to silicon ratio approximating $2MgO.SiO_2$. FIGS. 19A-19D constitute a scanning electron micrograph magnification series for untreated mill glass coated GOES. FIGS. 19E-19H constitute a scanning electron micrograph magnification series for mill glass coated GOES treated with 10 percent citric acid for 5 minutes. The treated mill glass, shown in the magnification series of scanning electron micrographs of FIGS. 19E through 19H, appears to be flatter and more grainy than the untreated mill glass, shown in the magnification series of scanning electron micrograph of FIGS. 19A through 19D, but otherwise appears the same.

Example 7

A ingot of GOES is conventionally thermomechanically processed using hot rolling, cold rolling, and annealing steps. After the final cold rolling, the GOES sheet undergoes a final normalizing in an atmosphere of hydrogen and nitrogen. This forms a thin oxide layer on the surface that contains silicon and iron. The GOES sheet surface is then coated with magnesium oxide (MgO) powder in an excess, which prevents the coil laps from sticking during the final hot annealing step. The GOES sheet is subjected to a final annealing in a hydrogen atmosphere to form a thin, uniform, silicon-rich insulating layer of crystalline forsterite ($Mg_2SiO_4$) on the sheet surface. The strip is uncoiled on a continuous heat flattening and scrubbing station that removes the excess MgO powder. The scrubbing station includes vigorous brushing and water spraying. The strip is contacted with 5% citric acid solution, either by spraying or immersion, with a contact time of 10 seconds. The strip is then rinsed with water. After rinsing, the strip is heat flattened in a furnace, which removes wrinkles and waves by heating to elevated temperature while lightly pulling on the strip. After this step, the strip cools and then is top coated using the monomagnesium phosphate compound. It then goes in a second furnace which cures the coating by firing it. The top coated strip has an average Franklin insulation value of less than about 0.1 ampere.

Example 8

The finished steel from Example 7 is slit to an appropriate width and sent to a core fabricator. The core steel is cut to size and is either stacked in an E-I manner or wound to form a transformer core.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining and/or modifying any of the disclosed steps, ingredients, constituents, components, elements, features, aspects, and the like, of the embodiments described herein. Thus, this disclosure is not limited by the description of the various exemplary, illustrative, and non-limiting embodiments, but rather solely by the claims. In this manner, it will be understood that the claims may be amended during prosecution of the present patent application to add features to the claimed invention as variously described herein.

What is claimed is:

1. A method of reducing the height of iron mound defects on a mill glass coated electrical steel, the method comprising:

contacting at least a portion of a surface of the mill glass coated electrical steel with an acidic solution for a contacting time sufficient to reduce an average height of iron mound defects on the at least a portion of the surface to an average height in a range of greater than 0 and up to 150 percent of the thickness of the mill glass coating;

wherein the acidic solution comprises an organic acid; and rinsing the acid contacted mill glass coated electrical steel with water;

wherein the contacting does not effectively remove the mill glass coating.

2. The method of claim 1, wherein the contacting does not increase an average Franklin test of the mill glass coated electrical steel.

3. The method of claim 1, wherein the acid solution comprises an aqueous acidic solution.

4. The method of claim 1, wherein the acidic solution comprises a carboxylic acid.

5. The method of claim 1, wherein the acidic solution comprises a multifunctional carboxylic acid.

6. The method of claim 1, wherein the acidic solution comprises a tricarboxylic acid.

7. The method of claim 1, wherein the acidic solution comprises citric acid.

8. The method of claim 7, wherein the acidic solution comprises 4 percent to 20 percent by weight of citric acid.

9. The method of claim 7, wherein the acidic solution comprises 10 percent to 15 percent by weight of citric acid and the contacting time is in a range of 10 seconds to 5 minutes.

10. The method of claim 1, wherein the contacting time is in a range of 5 seconds to 20 seconds.

11. The method of claim 1, wherein the electrical steel is a grain oriented electrical steel.

12. The method of claim 1, wherein a mill glass coating on the electrical steel comprises a forsterite oxide mill glass coating.

13. A method of reducing iron mound defect heights on a mill glass coated grain oriented electrical steel, comprising:

providing a mill glass coated grain oriented electrical steel;

contacting at least a portion of a surface of the mill glass coated grain oriented electrical steel with an acidic solution for a contacting time sufficient to reduce an average height of iron mound defects on the at least a portion of the surface to an average height of greater than 0 and up to 150 percent of the thickness of the mill glass coating;

wherein the acidic solution comprises an organic acid; and rinsing the acid contacted mill glass coated grain oriented electrical steel with water;

wherein the contacting does not effectively remove the mill glass coating.

14. The method of claim 13, wherein the contacting does not increase an average Franklin test value of the mill glass coated grain oriented electrical steel.

15. A method of reducing iron mound defect heights on a mill glass coated electrical steel, comprising:

acid treating at least a portion of a surface of a mill glass coated electrical steel with a 4 percent to 20 percent by weight carboxylic acid solution for an acid treatment time in a range of 5 seconds to 5 minutes;

rinsing the acid treated mill glass coated electrical steel with water; and drying the rinsed acid treated mill glass coated electrical steel;

wherein the acid treating does not effectively remove the mill glass coating.

16. The method of claim 15, wherein the carboxylic acid solution comprises citric acid.

17. The method of claim 15, wherein the electrical steel is a grain oriented electrical steel.

18. A method of forming an electrical transformer core, comprising:

providing a plurality of grain oriented electrical steel strips treated according to the method of claim 1; and stacking the plurality of electrical steel strips to form an EI transformer core.

19. A method of forming an electrical transformer core, comprising:

providing a plurality of grain oriented electrical steel strips treated according to the method of claim 1; and winding the plurality of electrical steel strips to form a wound transformer core.

20. The method of claim 13, wherein the acidic solution comprises an aqueous citric acid solution comprising 4 to 20 percent by weight of citric acid, and wherein the contacting time is in a range of 5 seconds to 5 minutes.

21. A method of reducing iron mound defect heights on a forsterite oxide mill glass coated grain oriented electrical steel, comprising:

providing a forsterite oxide mill glass coated grain oriented electrical steel;

contacting at least a portion of a surface of the forsterite oxide mill glass coated grain oriented electrical steel with an aqueous citric acidic solution for a contacting time;

wherein the aqueous citric acid solution comprises 4 to 20 percent by weight of citric acid; and wherein the contacting time is in a range of 5 seconds to 5 minutes; and rinsing the acid contacted forsterite oxide mill glass coated grain oriented electrical steel with water;

wherein the contacting does not effectively remove the forsterite oxide mill glass coating.

22. The method of claim 21, wherein the acidic solution comprises 10 percent to 15 percent by weight of citric acid and a the contacting time is in a range of 10 seconds to 5 minutes.

* * * * *

UNITED STATES PATENT AND TRADEMARK OFFICE

CERTIFICATE OF CORRECTION

PATENT NO. : 8,790,532 B2
APPLICATION NO. : 13/352743
DATED : July 29, 2014
INVENTOR(S) : Rakowski It is certified that error appears in the above-identified patent and that said Letters Patent is hereby corrected as shown below:

On the Title Page, in Column 1, delete Item "(73) Assignee: ATI Properties, Inc., Albany, NY (US)" and insert -- (73) Assignee: ATI Properties, Inc., Albany, OR (US) --, therefor.

On the Title Page, in Column 2, Item (57), in the abstract, line 5, delete "reduce an average height of iron defects on the surface to a an" and insert -- reduce an average height of iron defects on the surface to an --, therefor.

In the Specification,

In Column 1, line 60, delete "The forsterite coated GOES sheet is scrubbed cleaned. GOES" and insert -- The forsterite coated GOES sheet is scrubbed clean. GOES --, therefor.

In Column 11, line 55, delete "person skilled in the art, such a R cores and toroidal cores are" and insert -- person skilled in the art, such as R cores and toroidal cores, are --, therefor.

In Column 11, line 63, delete "core are know to a person having ordinary skill in the art, and" and insert -- core are known to a person having ordinary skill in the art, and --, therefor.

In Column 12, line 43, delete "5 show a smooth featureless surface. Surface photographs of" and insert -- 5 shows a smooth featureless surface. Surface photographs of --, therefor.

In Column 13, line 6, delete "Scrub material strips sample were immersed in 15 percent" and insert -- Scrub material strip samples were immersed in 15 percent --, therefor.

In Column 15, line 62, delete "A ingot of GOES is conventionally thermomechanically" and insert -- An ingot of GOES is conventionally thermomechanically --, therefor.

Signed and Sealed this
Tenth Day of February, 2015

Michelle K. Lee

Michelle K. Lee
*Deputy Director of the United States Patent and Trademark Office*

In the Claims,

In Column 18, line 42, delete “and a the contacting time is in a range of 10 seconds to 5” and insert -- and the contacting time is in a range of 10 seconds to 5 --, therefor.